US008449341B2

(12) United States Patent
Denise et al.

(10) Patent No.: US 8,449,341 B2
(45) Date of Patent: May 28, 2013

(54) FLOATING SUPPORT COMPRISING A DRUM EQUIPPED WITH TWO BUOYS TO WHICH TO FASTEN TETHERS AND PIPES CONNECTING BETWEEN THE SEA BED AND THE SURFACE

(75) Inventors: Jean-Paul Denise, Hyeres (FR); Thomas Marty, Aix en Provence (FR)

(73) Assignee: Saipem S.A., Montigny le Bretonneux (FR)

( * ) Notice: Subject to any disclaimer, the term of this patent is extended or adjusted under 35 U.S.C. 154(b) by 196 days.

(21) Appl. No.: 13/057,630

(22) PCT Filed: Aug. 28, 2009

(86) PCT No.: PCT/FR2009/051641

§ 371 (c)(1),
(2), (4) Date: Feb. 4, 2011

(87) PCT Pub. No.: WO2010/026334

PCT Pub. Date: Mar. 11, 2010

(65) Prior Publication Data

US 2011/0130057 A1 Jun. 2, 2011

(30) Foreign Application Priority Data

Sep. 5, 2008 (FR) ..... 08 55984

(51) Int. Cl.
*B63B 22/02* (2006.01)

(52) U.S. Cl.
USPC ..... 441/5; 114/230.12; 441/4

(58) Field of Classification Search
USPC ..... 441/3, 4, 5; 114/230.12, 230.13
See application file for complete search history.

(56) References Cited

U.S. PATENT DOCUMENTS

| | | | | |
|---|---|---|---|---|
| 4,604,961 | A * | 8/1986 | Ortloff et al. | 114/230.12 |
| 4,892,495 | A * | 1/1990 | Svensen | 441/5 |
| 5,363,789 | A * | 11/1994 | Laurie et al. | 441/4 |
| 5,860,840 | A | 1/1999 | Boatman et al. | |

FOREIGN PATENT DOCUMENTS

| | | |
|---|---|---|
| GB | 2321631 | 8/1998 |
| WO | WO 93/24733 | 12/1993 |

OTHER PUBLICATIONS

International Search Report dated Feb. 10, 2010.

* cited by examiner

*Primary Examiner* — Lars A Olson
(74) *Attorney, Agent, or Firm* — Cozen O'Connor

(57) ABSTRACT

An oil production floating support having a mooring device for mooring anchor lines anchoring to the bottom of the sea and bottom-to-surface connection pipes. The device has two mooring buoys having the anchor lines and the bottom-to-surface connection pipes moored respectively thereto. The said two mooring buoys being connectable and disconnectable to a turret under which they are fastened, independently of each other.

16 Claims, 12 Drawing Sheets

FIG.8
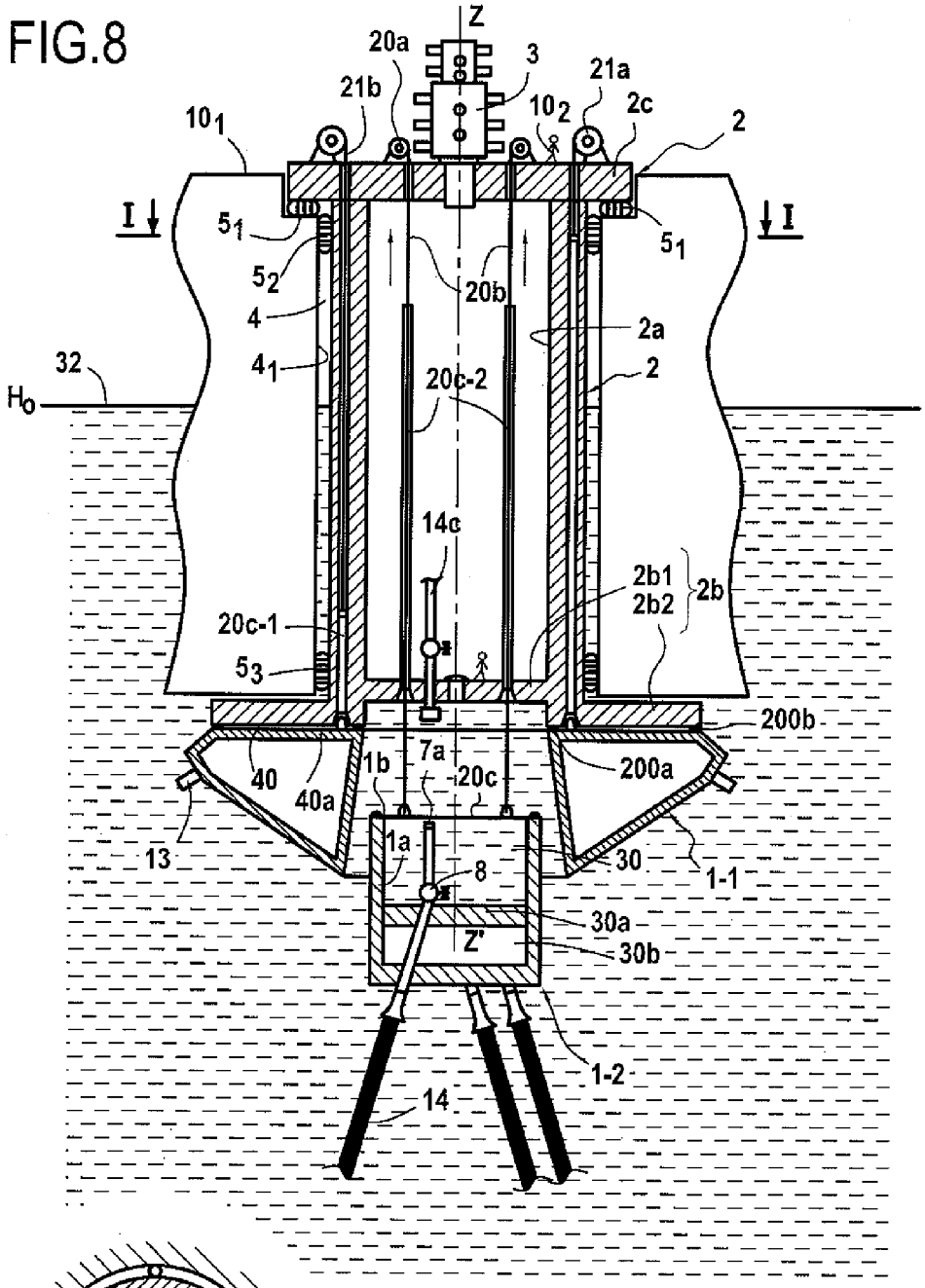
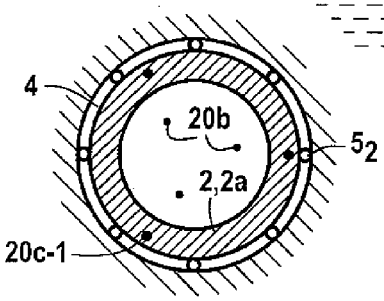
FIG.9

FLOATING SUPPORT COMPRISING A DRUM EQUIPPED WITH TWO BUOYS TO WHICH TO FASTEN TETHERS AND PIPES CONNECTING BETWEEN THE SEA BED AND THE SURFACE

PRIORITY CLAIM

This is a U.S. national stage of application No. PCT/FR2009/051641, filed on Aug. 28, 2009. Priority is claimed on the following application: France application Ser. No. 08/55984 Filed on Sep. 5, 2008, the content of which is incorporated here by reference.

FIELD OF THE INVENTION

The present invention relates to a floating support anchored to a disconnectable turret.

The technical field of the invention is more particularly the field of off-shore oil production in regions presenting extreme ocean and weather conditions, and in particular in Arctic or Antarctic regions, and working from floating supports.

In general, an oil production floating support has anchor means to enable it to remain in position in spite of the effects of currents, winds, and swell. It also generally includes drilling means, oil storage means, and oil processing means, together with means for off-loading to off-loading tankers, which tankers call at regular intervals to take away the production. Such floating supports or ships are conventionally referred to as floating production storage off-loading (FPSO) vessels or indeed as floating drilling & production units (FDPU) when the floating support is also used for performing drilling operations with wells that are deflected in the depth of the water. The abbreviation FPSO is used below.

When weather and sea conditions, i.e. swell, wind, and current are severe or even extreme, as during storms, it is preferred to anchor the FPSO via a turret, generally situated in known manner in the front half of the ship and on its axis, with the ship being free to turn about said turret under the effect of the wind, current, and swell. Thus, with wind, current, and swell exerting specific forces on the hull and the superstructures, the FPSO makes use of its freedom to turn about the vertical axis ZZ so as to put itself naturally in a position of least resistance. The pipes connecting it with the well heads are generally connected to the underside of the turret and they are connected to the FPSO via a rotary joint lying on the axis of said turret. When weather conditions might become extreme, as in the North Sea, in the Gulf of Mexico, or in the Arctic or the Antarctic, the FPSO is generally disconnectable so as to be capable of taking shelter and waiting for acceptable operating conditions to return.

The present invention relates more particularly to a floating support for off-shore oil production in the Arctic or the Antarctic, the support being fitted under its hull with a disconnectable turret from where there extend anchor lines connected to the sea bottom and bottom-to-surface connection pipes, said hull including in its longitudinal direction substantially plane sides that extend vertically, and possibly also in conventional manner bow and stern portions (at the front and rear ends of the ship) that are inclined relative to the horizontal and that are preferably shaped so as to form a reinforced pointed stem capable of breaking pack ice merely by bending it whenever said pack ice forces it way under said reinforced stem.

BACKGROUND OF THE INVENTION

Floating supports advantageously present a hull with substantially vertical longitudinal sides in order to optimize their oil storage capacities, and also to obtain better behavior in heavy sea. However a hull with vertical sides is particularly disadvantageous in terms of behavior relative to pack ice. Thus, in U.S. Pat. No. 4,102,288 and U.S. Pat. No. 4,571,125, floating supports are proposed that present, amongst other means, sides with profiles that are curved or inclined so as to enhance ice breaking in the manner that is known for a ship's bow having a stem that slopes relative to the horizontal.

In known manner, an oil production floating support including a releasable mooring system of anchor lines anchored to the sea bottom and of bottom-to-surface connection pipes comprises:

- a mooring buoy for said anchor lines and bottom-to-surface connection pipes, said buoy preferably being an annular buoy; and
- said mooring buoy being fastened under the hull of the floating support to a rotary device having a tower-shaped structure referred to as a "turret", said turret co-operating with the hull within a cavity passing through the entire height of the hull of the floating support, said turret being rotatably mounted relative to said hull via at least one rolling or friction bearing, preferably a rolling bearing, so as to allow said floating support to turn about a substantially vertical axis ZZ' of said turret and of said cavity without causing said mooring buoy to turn relative to the same vertical axis ZZ'; and
- said bottom-to-surface connection pipes rise within the cavity to a coupling for a plurality of said pipes, said coupling being secured to the floating support level with the deck of the floating support, said coupling being ratably mounted so as to allow said floating support to turn without turning said coupling that is of the rotary joint coupling type.

In the above-described prior art, the rolling bearing is located either level with the deck of the floating support, or else in the bottom portion under water, i.e. the bearing is immersed, or indeed a combination of the above two configurations may be used.

Embodiments in which the rolling bearing is located solely level with the deck are suitable only for floating supports of relatively small height, in particular less than 15 meters (m). With greater heights, for floating supports having a height lying in the range 20 m to 25 m, in particular, the horizontal force on the turret resulting from the floating support turning gives rise to the structure of the turret bending along its length, thereby mechanically stressing the top rolling bearing and thus mechanically endangering its reliability of operation. Furthermore, when the rolling bearing is underwater in the bottom portion of the turret, this immersion affects the operating reliability and the durability of said rolling bearing, and above all gives rise to difficulties in performing maintenance operations. On-site action requires the use of divers and of considerable technical means, and it is generally necessary to perform such operations in a protected zone, such as a fjord, or better still in a dry dock, after the FPSO has been disconnected. Thus, when an FPSO is intended to remain in position for several tens of years without any programmed maintenance disconnections in dry dock or in a protected site, that type of turret is not suitable.

Supports of the above-defined type are known from GB 2 291 389 and EP 0 259 072.

WO 94/15828 describes a system for quickly connecting and disconnecting a mooring buoy, in which the mooring buoy has a top portion that is connected to the bottom of the hull of the floating support, more precisely via a mooring cavity that extends annularly at the bottom end of a cavity passing through the entire height of the hull of the floating support with the bottom-to-surface connection pipes passing up therethrough. The mooring buoy also has a bottom portion to which there are moored the anchor lines and bottom portions of bottom-to-surface connection pipes extending to the sea bottom, said bottom portion of the mooring buoy being rotatably mounted by means of a rolling bearing that is completely immersed, enabling said bottom portion to turn relative to the top portion of the mooring buoy secured to the hull.

That type of system with a completely immersed rotary portion and rolling bearings that are completely immersed is not suitable for mooring bottom-to-surface connection pipes in large numbers, for which it is desirable to propose a system in which at least some of the rolling bearings are situated out of the water so that they can be maintained more easily and so that they can be implemented in operating conditions that are less constraining.

In WO 94/15828, provision is made at the bottom of the hull for internal tanks presenting a large area in horizontal section in which atmospheric pressure or preferably a vacuum is established. Said internal tanks present a large area of contact in horizontal section with the top portion of the mooring buoy, with the buoy being designed to be fastened thereagainst. For this purpose, an interstitial annular zone is created between the mooring buoy and the tank at atmospheric pressure at the bottom of the hull of the ship, which zone is defined by two concentric annular gaskets, which annular zone of small volume is put into contact with the chamber at atmospheric pressure at the bottom of the hull of the ship in order to create positive buoyancy for the assembly constituted by the mooring buoy and the anchor lines and the bottom-to-surface connection pipes that are pressed against said contact area.

Under certain conditions, it may be desirable to disconnect only the bottom-to-surface connection pipes, while maintaining said floating support moored to the bottom by said anchor lines, which anchor lines are moored on said mooring buoy.

Circumstances of this type occur in particular when it is desired temporarily to shelter the bottom-to-surface connection pipes since they are more fragile than the anchor lines, in particular when the bottom-to-surface connection pipes include flexible pipes providing the connection between said mooring buoy and a buoy immersed in the sub-surface, without it being necessary to cast off said anchor lines.

In mooring systems with a single annular mooring buoy fastened to a turret, as in GB-2-321 631, having fastened thereto both said anchor lines and said connection pipes, it is not possible to cast off the bottom-to-surface connection pipes without previously disconnecting and lowering the mooring buoys to which they are moored, whenever the sea is rough both at the surface and in the sub-surface. It is then necessary initially to cast off the mooring buoy in order to lower it to a sufficient depth where the sea is calmer and where there is no risk of damaging the bottom-to-surface connection pipes while they are being cast off from the buoy. Otherwise, there would a risk of damaging the connectors at the top ends of the portions of bottom-to-surface connection pipes that are connected to the buoy. However disconnecting the buoy then implies that the floating support is no longer anchored, at least temporarily, and that is not always desirable.

EP-0 831 023 describes a mooring buoy constituted by two independent portions consisting in an annular first buoy having moored thereto exclusively said anchor lines for the floating support, and a second buoy that is coaxially secured in releasable manner to said first buoy, i.e. it is disconnectable therefrom, occupying the central orifice of said first buoy, with said bottom-to-surface connection pipes being moored exclusively to said second buoy. Nevertheless, in the embodiment as described in EP-0 831 023, both buoys are completely contained in a cavity within the hull of the floating support and are thus connected and therefore disconnectable exclusively by mechanical locking means that are complicated and very difficult to implement when forces become large, which forces may reach or exceed 5000 (metric) tonnes (t) to 6000 t.

SUMMARY OF THE INVENTION

The object of the present invention is to provide a mooring device that is reversibly connected to the floating support including at least one mooring buoy, which device has fastened thereto said anchor lines and bottom-to-surface connection pipes, said mooring device co-operating with a turret, the structure and the operation of said mooring device being such that the device allows the bottom-to-surface connection pipes to be disconnected independently without risk of damaging them, while keeping the floating support anchored via said anchor lines.

Another object of the present invention is to provide a connection/disconnection system for said mooring device that is fast and based on the principle of creating positive buoyancy between the mooring buoy and the anchor lines and/or the bottom-to-surface connection pipes that are moored thereto, the connection/disconnection system of the buoy also needing to be adapted to an implementation in which said mooring device is fastened beneath a rotary turret within a cavity that preferably extends through the full height of the hull of the ship, said mooring device being mounted rotatably relative to said hull using at least one rolling bearing, which bearing is preferably not liable to become immersed in operation.

To do this, the present invention provides an oil production floating support comprising:

a mooring device for mooring anchor lines at the bottom of the sea and first bottom-to-surface connection pipes extending from said mooring device where they are moored down to the bottom of the sea, said mooring device comprising at least one annular mooring buoy, said mooring device being connected reversibly to a turret; and said turret comprising at least one watertight tubular structure, preferably of circular section about said vertical axis ZZ', having a bottom wall assembled in watertight manner to the bottom end of the tubular side wall of said watertight tubular structure, said turret extending in a through cavity passing within the hull of the floating support, preferably up its entire height, said turret being rotatably mounted relative to said hull by means of at least one rolling or friction bearing preferably situated above the water line and/or out of the water, preferably a rolling bearing, so as to allow said floating support to turn about a substantially vertical axis ZZ' of said turret and of said cavity without causing said mooring buoy to turn relative to the same vertical axis ZZ'; and second connection pipes between the top ends of said first bottom-to-surface connection pipes to which they are connected and the deck of the floating support, said second connection pipes passing through the bottom wall of the turret in watertight manner and rising within the cavity to a coupling for coupling a plurality of said second pipes, said coupling being secured to the floating support level with the deck of the floating support, said coupling, of the rotary joint coupling type, being rotatably mounted so as to allow said floating support to turn without turning said coupling, the bottom ends of said second connection pipes under said bottom wall of the turret being connected to the top ends of said first bottom-to-surface connection pipes by means of connectors co-operating with valves;

the support being characterized in that:

said mooring device comprises two mooring buoys disposed coaxially one relative to the other and about the axis ZZ' of the bottom wall of said turret, a first buoy being an annular buoy having said anchored lines moored thereto, and said annular buoy including a central orifice containing a second mooring buoy having said first bottom-to-surface connection pipes moored thereto, said second mooring buoy having a top tubular wall within which said valves and connectors are situated at the top ends of said first connection pipes; and said floating support includes a connection/disconnection system for connecting/disconnecting said first and/or said second mooring buoy(s) respectively relative to said bottom wall of the turret, enabling each of said respective first or second mooring buoys to be connected/disconnected independently of the other, the connection/disconnection system comprising:

two sealing gaskets on the top face of said annular first buoy, said gaskets preferably being coaxial about the axis ZZ' of the central orifice of said first buoy, defining a first watertight chamber or interstitial annular chamber between the bottom wall of said turret and the top face of said first buoy when said top face of said first buoy is pressed against the bottom wall of said turret; and said tubular top wall of said second buoy co-operating with the bottom wall of said turret to define a second watertight chamber referred to as the valve chamber, when a sealing gasket on the top edge of said tubular top wall of the second buoy is pressed against the bottom wall of said turret, against the underface thereof; and a plurality of links, such as hoist cables fastened to said mooring buoy, preferably to the top edge of said tubular top wall of said second mooring buoy, said links preferably extending inside the turret and passing through the bottom wall of the turret in watertight manner; and at least two vent tubes extending vertically inside the turret from a level situated above the water line to the bottom wall of the turret through which they pass in watertight manner via each of said first and second chambers respectively; and pump means for pumping the water in each of said first and second chambers respectively when said first and second corresponding buoy is respectively pressed against the bottom wall of the turret; and the dead weight of said first mooring buoy and anchor lines and respectively the dead weight of said second mooring buoy and of said first bottom-to-surface connection pipes is less than the weight of the volume of water $V_i$ such that $V_i=S_i\times(H_0-H_2)$ in which:

$H_0$ is the height of water at the water line;

$H_{2i}$ is the height of the top portion of the bottom wall of the turret defining said first chamber or said second chamber respectively;

$S_i$ is the area of the cross-section of said first chamber or of said second chamber respectively; and i=a for said first buoy and said first chamber and i=b for said second buoy and said second chamber.

The weight of the volume of water $V_i$ corresponds to the buoyancy thrust acting on the horizontal section $S_i$ of said first or second chamber.

Thus no part of the turret and/or the mooring device is secured in permanent manner relative to the hull.

The mooring device of the present invention enables the second buoy to be disconnected and lowered on its own to a certain depth of immersion beneath the floating support, so as to shelter the first connection pipe from turbulence at the surface and in the sub-surface, while keeping the first buoy connected, together with the anchor lines that are moored thereto, and thus with the floating support continuing to be anchored.

Furthermore, it can be understood that in the event of extreme conditions, it is safer to disconnect the second buoy carrying only the first bottom-to-surface connection pipes in preventative manner and to lower it to a certain depth, without disconnecting the first buoy to which the anchor lines are moored, which lines exert a stronger return force on the first buoy to which they are moored.

In addition, the connection/disconnection system is particularly easy to implement on the following principle.

When the top face of the first buoy or the top edge of the top tubular wall of the second buoy is pressed into contact against the underface of the bottom wall of the turret, said first or second chamber respectively being full of water, a connection is made between said buoy and said bottom wall of the turret by creating positive buoyancy in the assembly comprising said first buoy and said anchor lines or respectively said second buoy and said first bottom-to-surface connection pipes. To do this, water is pumped from inside said first or second chamber, as the case may be, until the level of water in said guide tubes lies in the range $H_{1i}$; and $H_{2i}$, where $H_{1i}$ corresponds to the height at which the volume of water $V_{1i}=S_i\times(H_0-H_{1i})$ is equal to the dead weight of said first buoy together with said anchor lines or of said second buoy together with said first bottom-to-surface connection pipes, with i=a for the first buoy and the first chamber and i=b for the second buoy and the second chamber. To disconnect said buoy from the turret, said first or second chamber is filled with water, said vent and guide tube(s) maintaining said first or second chamber as the case may be substantially at atmospheric pressure while it is being filled, until the level of water in said guide tubes is at a height slightly above $H_{1i}$. When the dead weight of the assembly constituted by the buoy being filled and said first connection pipes or anchor lines exceeds the weight of the volume of water $V_{1i}=S_i\times(H_0-H_{1i})$, the buoy naturally begins to separate from the turret and begins to move downwards. Once the buoy has become detached from the bottom of the turret it experiences a level of hydrostatic pressure that corresponds to the level of its depth in the sea and said buoy therefore moves quickly downwards with a considerable force corresponding to its own weight, i.e. 500 t to 1500 t, thereby releasing the floating support from its attachment to the turret in almost instantaneous manner.

Preferably, the floating support comprises a plurality of said hoist cables extending from winches preferably located on the deck of the ship or at the top of said turret, above the water line, said cables where appropriate extending inside a plurality of vent and guide tubes extending vertically inside the turret from a level above the water line down to the bottom of the turret through which they pass in watertight manner.

Also preferably, for at least one of said first and second buoys, preferably for each of said first and second buoys, said connection/disconnection system includes at least three said cables and at least three said guide tubes preferably disposed symmetrically about the center of the circular bottom of said turret, and preferably along and close to the outside surface of said tubular structure of said turret for said first buoy or close to the inside surface of said tubular structure of said turret for said second buoy, respectively, the bottom ends of said cables being fastened of the top face of said first buoy, or respectively to the top edge of said top tubular wall of said second buoy.

This arrangement of said cables during the reconnection stages, makes it possible to cause said buoy to advance and approach the underface of the bottom of the turret in controlled and stable manner by synchronizing the actuation of the winches winding in said hoist cable.

More particularly, the diameter of said guide tubes and the immersion depths of the portion of the bottom wall of the turret on which said guide tubes rest, where i=a or b, are such that the inside volume of the guide tubes is less than 15 cubic meters ($m^3$), preferably less than 5 $m^3$, for a turret having an immersed height $H_0$–$H_2$ within said cavity of at least 20 m, and more particularly preferably 20 m to 50 m.

Still more particularly, said top tubular end wall of said second buoy includes, at its bottom end, a bottom wall to which it is assembled in watertight manner, forming the bottom wall of the valve chamber supporting said valves and/or automatic connector portions, and said buoy includes, in its bottom portion, a buoyancy tank constituting a float against the underface of the bottom wall of the valve chamber.

It can be understood that the tubular top wall of the second buoy presents a height that is necessary and sufficient for installing said valves and automatic connectors for connecting together the first and second pipes.

Still more particularly, the floating support includes at least one said pump preferably situated in the bottom portion inside said watertight tubular structure constituting the turret, said pump co-operating with a suction pipe passing in watertight manner through said bottom wall of the turret, said suction pipe coming close to the wall of each of said first and second chambers when said first or second buoy is respectively in position pressed against said bottom wall of the turret, and said pump co-operating with a delivery pipe for each of said first and second chambers, each said delivery pipe opening out into said cavity, preferably passing through the tubular side wall of said watertight tubular structure constituting the turret, preferably in the bottom portion of said turret.

Advantageously, the bottom wall of said turret comprises:

a preferably circular central portion assembled in watertight manner with said side tubular wall of said turret inside it and above the bottom end of said side tubular wall, and a peripheral portion surrounding said central portion, preferably an annular peripheral portion assembled in watertight manner to the bottom end of said side tubular wall or to the outside face of said side tubular wall of the turret, being offset downwards relative to said central portion in such a manner that the bottom ends of said second link pipes, preferably including connector portions at the underface of said central portion of the bottom wall, are situated above the bottom end of the side tubular wall of the watertight tubular structure of the turret.

This embodiment is particularly advantageous in that it enables said first buoy, on being disconnected, to avoid any risk of damaging the bottom ends of the second connection pipes, in particular the automatic connector portions, when casting off said first buoy, given the considerable return forces to which said first buoy is subjected when the FPSO is itself subjected to large amounts of horizontal movements as a result of swell, wind, current, or indeed drifting pack ice. The first buoy is thus not disconnected until after said second buoy has been disconnected and cast off from the central orifice of said first buoy.

The bottom ends of the second pipes, in particular the connector portions at the bottom ends of the second pipes are thus sheltered, being protected by the bottom portion of the tubular side wall situated beneath said central portion of the bottom wall of the turret.

This offset between the central portion and the peripheral portion of said bottom wall forms a cavity defined by the bottom end of the inside surface of the tubular side wall of the turret and the underface of the central portion of the bottom wall.

This casing forms a centering guide member suitable for containing and wedging said second mooring buoy in position when it is pressed against the underface of said bottom wall to enable said first and second connection pipes to be connected together by said connectors.

It can be understood that said centering means facilitate centering the tubular top wall of said mooring buoy relative to said turret as it approaches the underface of said bottom of the turret and makes it easier, if need be, to connect the male and female portions of the automatic connectors at the top ends of said bottom-to-surface connection pipes projecting above the bottom of said second chamber with the bottom ends of said second connection pipes.

Also advantageously, the floating support comprises:

reversible mechanical safety locking or retaining means for locking or retaining each of said first and second mooring buoys against the underface of the bottom wall of said turret.

Still more particularly, each of said first or second mooring buoys includes abutments or protective guide members for limiting the flattening of said gaskets and for transferring vertical loads between said first or second buoy and the turret when said first or second buoy is pressed against the bottom wall of said turret, said annular gaskets being compressed between the underface of the bottom wall of said turret and said first or second mooring buoy, said protective guide member being suitable for co-operating with a hinged movable safety latch secured to the underface of the bottom wall of said turret, whereby said first or second mooring buoy is secured to said turret when said safety latch is engaged under said protective guide member.

Thus, in the event of the first or second chamber being flooded with sea water as the result of a leak, the total loss of buoyancy by the mooring buoy is compensated by the fastening achieved using said safety latches and there is no risk of said mooring buoy being cast off in untimely and destructive manner.

Preferably, said top tubular wall of the second buoy and/or the tubular side wall of the watertight tubular structure of said turret include(s) a filler valve co-operating with filler pipes for putting sea water into communication with the inside of said valve chamber, and said tubular wall of said valve chamber preferably includes a watertight hatch of large dimensions suitable for enabling said valve chamber to be filled almost instantaneously by sea water when said hatch is opened.

More particularly, the bottom wall of the turret includes an inspection hatch for inspecting said valve chamber.

Because it is possible to empty the valve chamber, that makes it possible for personnel to act in the dry in said chamber for maintenance purposes, and where appropriate for operating automatic connectors and valves providing the connections between said first and second pipes.

The present invention also provides a method of operating a floating support of the invention, wherein a said first or second mooring buoy is connected to the underface against the bottom wall of a said turret by performing the following steps:

a) immersing a said first or second mooring buoy, said anchor lines or said first bottom-to-surface connection pipes being moored respectively thereto; and b) securing the bottom ends of hoist cables to said first or second buoy, respectively, said floating support being positioned in such a manner that said first or second buoy, respectively, is substantially on the vertical axis ZZ' of said cavity; and c) actuating said winches to raise said first or second buoy until said sealing gaskets, in particular O-rings for said first mooring buoy or said gasket for said second mooring buoy is/are pressed against the underface of the bottom wall of said turret, thereby forming a said first or second chamber respectively that is filled with sea water, said guide tubes co-operating with said first or second chamber respectively being likewise filled with sea water up to a height $H_0$ corresponding substantially to the level of the water surface at the water line; and d) pumping out the water from inside said first or second chamber respectively, using said pump means until the level of water in said guide tubes co-operating with said first or second chamber, respectively, is less than the height $H_{1i}$, or preferably less than or equal to the height $H_{2i}$, respectively, the height $H_{1i}$ being such that the buoyancy corresponding to the weight of the volume of water $V_{1i}=S_i\times(H_0-H_{1i})$ where i=a for the first buoy and the first chamber and i=b for the second buoy and the second chamber, is greater than the weight of the assembly of said first mooring buoy and said anchor lines for said first watertight chamber or respectively greater than the weight of the assembly of said second mooring buoy and said link pipes for said second watertight chamber; and e) preferably completely emptying said first or second chamber respectively and then making it watertight.

As mentioned above, $H_{2b}$ represents the height relative to the sea bottom of the top edge of the tubular top wall of the second buoy and the height of the underface of the bottom wall portion of the turret when they are in contact with each other, and $S_b$ is the area of the cross-section of the tubular top wall of said second buoy or the area of the bottom wall of the turret as defined by the top edge of the tubular top wall of the turret when they are in contract. Likewise, $H_{2a}$ represents the height relative to the sea bottom of the top face of the first buoy and the height of the underface of the peripheral portion of the bottom wall of the turret when they are in contact, and $S_a$ is the area of the annular surface of the cross-section of said second chamber as defined by the two gaskets of the top face of the first buoy when they are in contact with the underface of the peripheral portion of the bottom wall of the turret.

More particularly, after said first or second chamber has been emptied, the bottom ends of said hoist cables are detached from said first or second mooring buoy, respectively, and preferably retaining means for mechanically retaining said first or said second mooring buoy, respectively, are engaged, thereby securing it to the bottom wall of said turret, preferably using a hinged movable safety latch suitable for co-operating with protective guide members preventing said sealing gaskets or said gasket that is/are compressed between said first or second mooring buoy respectively and the underface of the bottom wall of the turret from being flattened.

The present invention also provides a method of operating a floating support of the invention, wherein a said first or second buoy connected to a said turret is disconnected, wherein after the bottom ends of said hoist cables have been separated from said first or second buoy, the method comprises the following steps:

a) causing water to enter at least into said first or second watertight chamber respectively in such a manner that the level of water in said guide tubes co-operating with said first or second chamber respectively comes just above said level $H^{1i}$ with i=a for the first chamber and i=b for the second chamber; and b) for disconnecting said second buoy, unlocking the automatic connectors between said first and second link pipes; and c) releasing said mechanical retaining means to separate said first or second mooring buoy respectively from said bottom wall of the turret; and d) ending by filling the guide tubes in communication with the chamber, thereby causing said buoy to be disconnected.

Preferably, for disconnecting from said second buoy, the following steps are performed:

a) depressurizing said first and second bottom-to-surface connection pipes; and b) filling said second chamber or valve chamber up to said height $H_2b$ from the underface of the bottom wall of the turret, and stopping filling as soon as said valve chamber is completely filled with water; and c) releasing the automatic connectors between said first and second link pipes;

d) where appropriate, releasing said mechanical safety latches; and e) continuing to fill said valve chamber so as to fill the guide tubes up to the height Rib, thereby disconnecting said second buoy.

This two-stage disconnection technique is advantageous since, from the end of step b) and up to step d) inclusive, the second buoy is held in position by hydrostatic thrust and the process of casting off the second buoy remains reversible merely by emptying the chamber. This makes it possible to provide an intermediate disconnection stage or waiting stage in the event of it not being certain that the second buoy needs to be disconnected but in which it is desirable to be ready to be able to perform said disconnection as quickly as possible, should that become necessary, with this being done merely by filling the guide tubes in accordance with above step e). Thus, in the event of danger that is imminent but not certain, such as drifting pack ice or an iceberg, the preparatory stage which remains reversible is performed calmly (steps a) to d)), which stage might take several hours if it is necessary to burn off depressurization gas via the flare tower. Once it is confirmed that disconnection needs to be performed, the second stage (step e)), which step is irreversible, lasts for only a few tens of seconds or a few minutes, thereby enabling the buoy to be cast off and thus releasing the FPSO almost instantaneously from its bottom/surface connections, or where the first mooring buoy is concerned, from its anchoring.

Advantageously, in a method of the invention, the following steps are performed:

1) disconnecting said second buoy relative to said turret while keeping said first buoy connected to said turret; and 2) lowering said second buoy to a certain depth of immersion below said floating support while keeping the first link pipes moored to the second buoy.

BRIEF DESCRIPTION OF THE DRAWINGS

Other characteristics and advantages of the present invention appear better in the light of the following detailed description made in non-limiting and illustrative manner, with reference to the drawings, in which:

FIG. 8 is a section view and a side view or reconnecting the second buoy to the turret by means of winches and cables;

FIG. 9 is a section view on I-I of FIG. 8 through a top rolling bearing $\mathbf{5}_2$;

DETAILED DESCRIPTION OF THE PRESENTLY PREFERRED EMBODIMENTS

Figure 1:
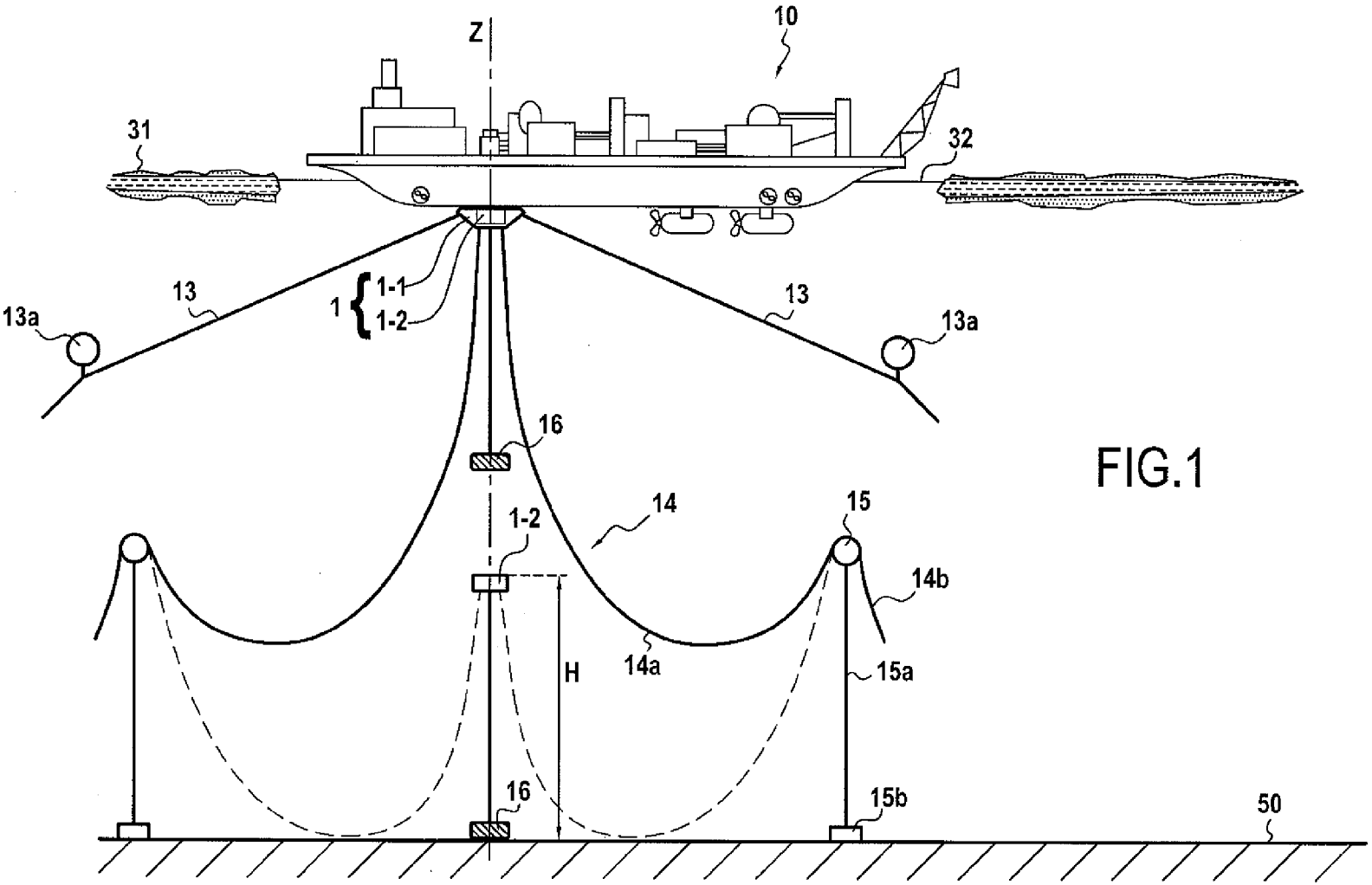
FIG. 1 is a section view and a side view of an FPSO type floating support anchored on a turret within pack ice.

FIG. 1 is a side view in section showing a ship or floating support of the FPSO type 10 anchored on a releasable mooring system 1 fitted at the underface of a turret 2 including a first buoy 1-1 onto which are anchored anchoring lines 13 and a second buoy 1-2 connected to undersea well heads (not shown) via flexible pipes referred to as first bottom-surface connection pipes 14 in a dipping catenary configuration 14*a* going down to a subsurface float 15 supporting said pipe. The float 15 is held by a cable 15*a* connected to a mooring block or "deadman" 15*b* at the bottom of the sea, after which said flexible pipe 14*a* extends in a catenary configuration 14*b* down to the bottom of the sea 50 and then to said well heads.

The structure and the ways in which said first and second buoys are connected/disconnected relative to the underface of the turret 2 independently of each other are described further on below.

Figure 2:
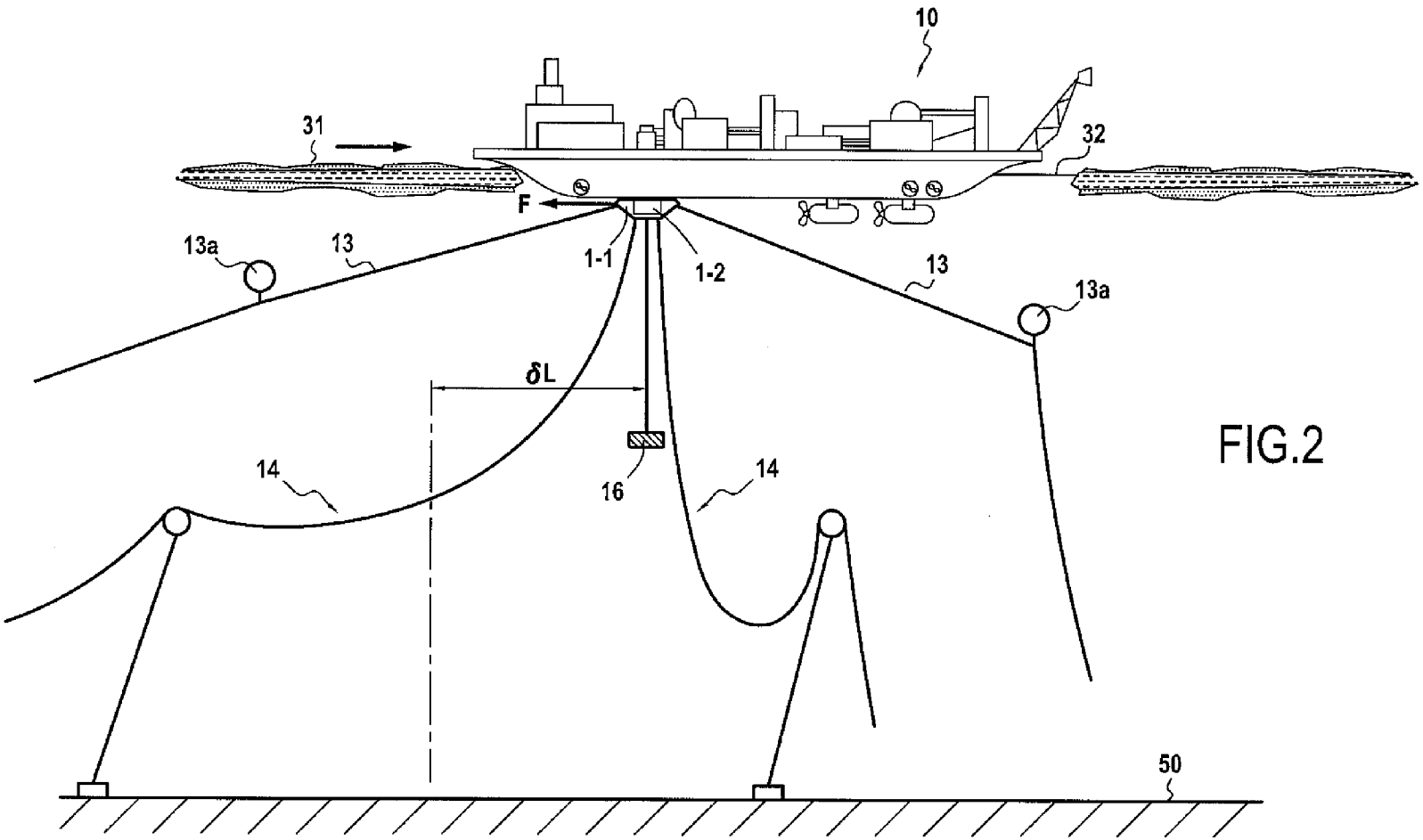
FIG. 2 is a section view and a side view of an FPSO subjected to extreme horizontal thrust from drifting pack ice 31.

FIG. 2 is a side view of an FPSO being pushed by drifting pack ice 31, thereby giving rise to an offset SI, that has the effect of modifying the configuration of the catenaries 14*a* of the connection pipes 14 on the left to an extreme extent, a force F being applied to the first buoy 1-1 and transmitted to the turret 2 of the FPSO, keeping it in position.

Figure 3:
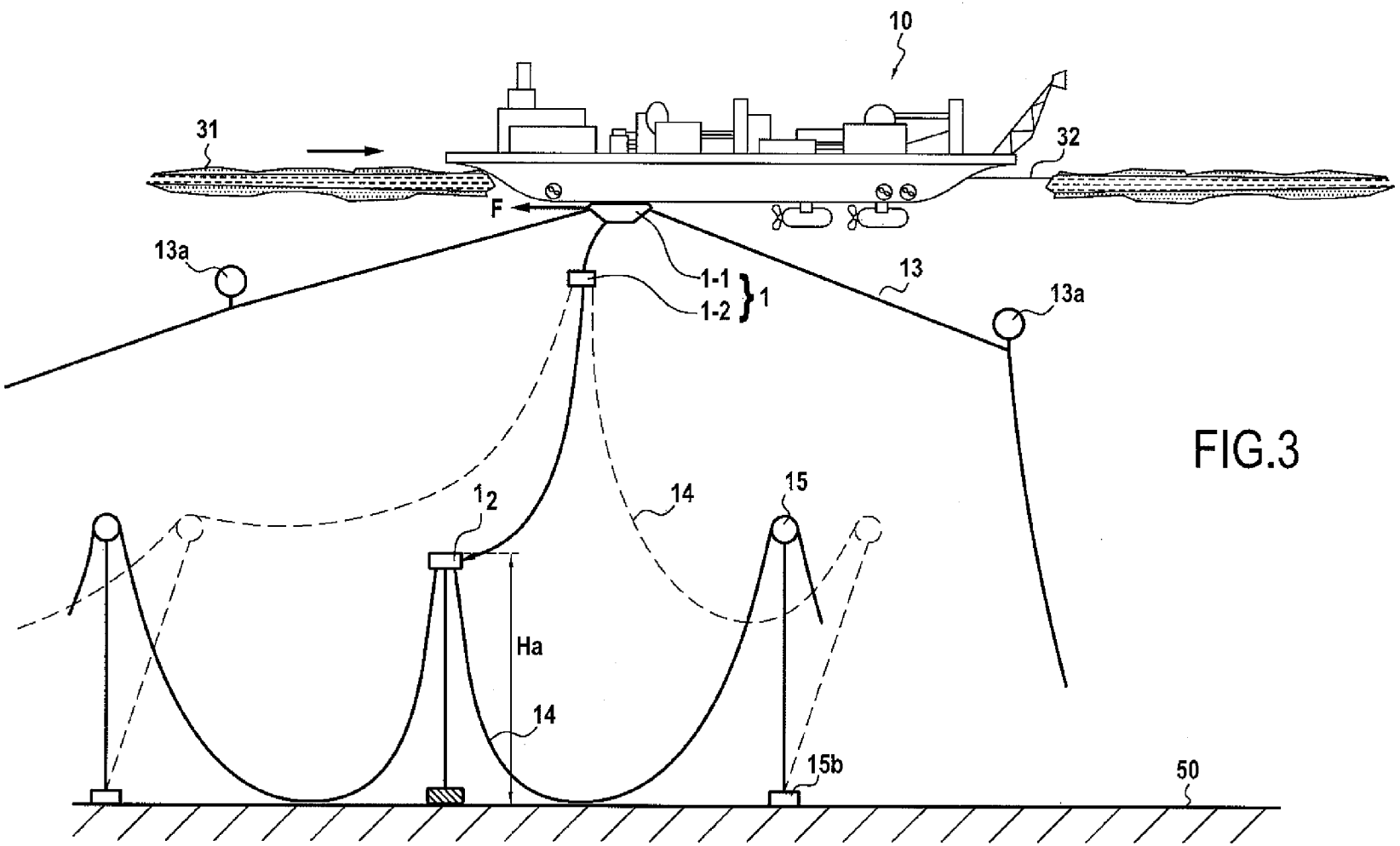
FIG. 3 is a side view of casting off a second buoy supporting flexible connection pipes 14, the FPSO being held in position by the anchor lines secured to a said first buoy.

FIG. 3 shows the second buoy 1-2 being disconnected, which buoy drifts somewhat and then stabilizes at a height Ha above the sea bottom 50. A mooring block 16 connected to the second buoy 1-2 serves to stabilize the second buoy 1-2 at the height Ha, with the mooring block 16 resting on the sea bottom 50. The first buoy is still connected to the FPSO and keeps it in position.

Figure 4:
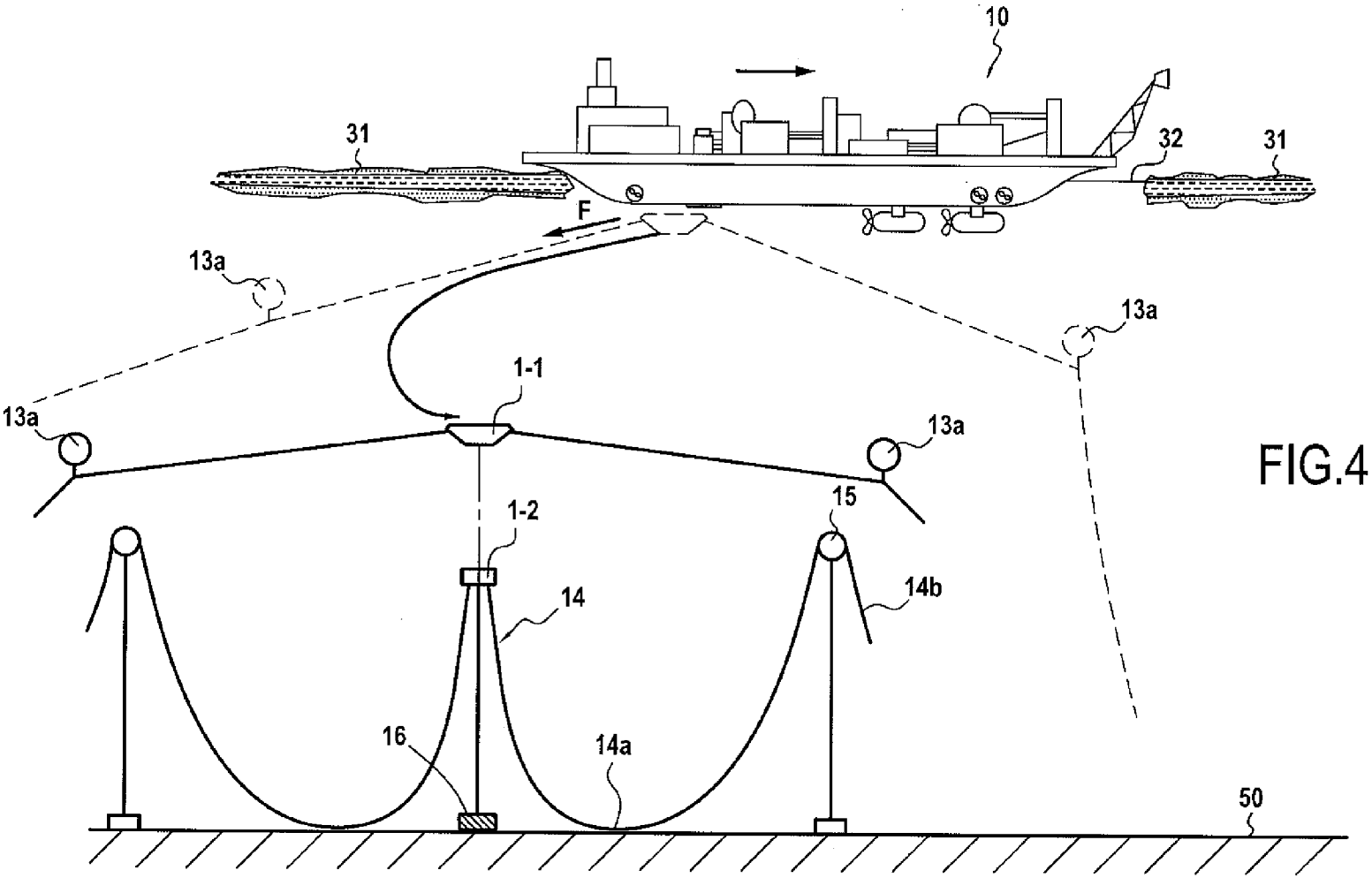
FIG. 4 is a side view of the subsequent casting off of said first buoy in order to release the FPSO from the pack ice.

In FIG. 4, the first mooring buoy 1-1 is cast off suddenly. It also drifts, and becomes stabilized at a height Hb above the sea bottom 50. The FPSO is then free and can leave the pack ice in order to find shelter.

Figure 5:
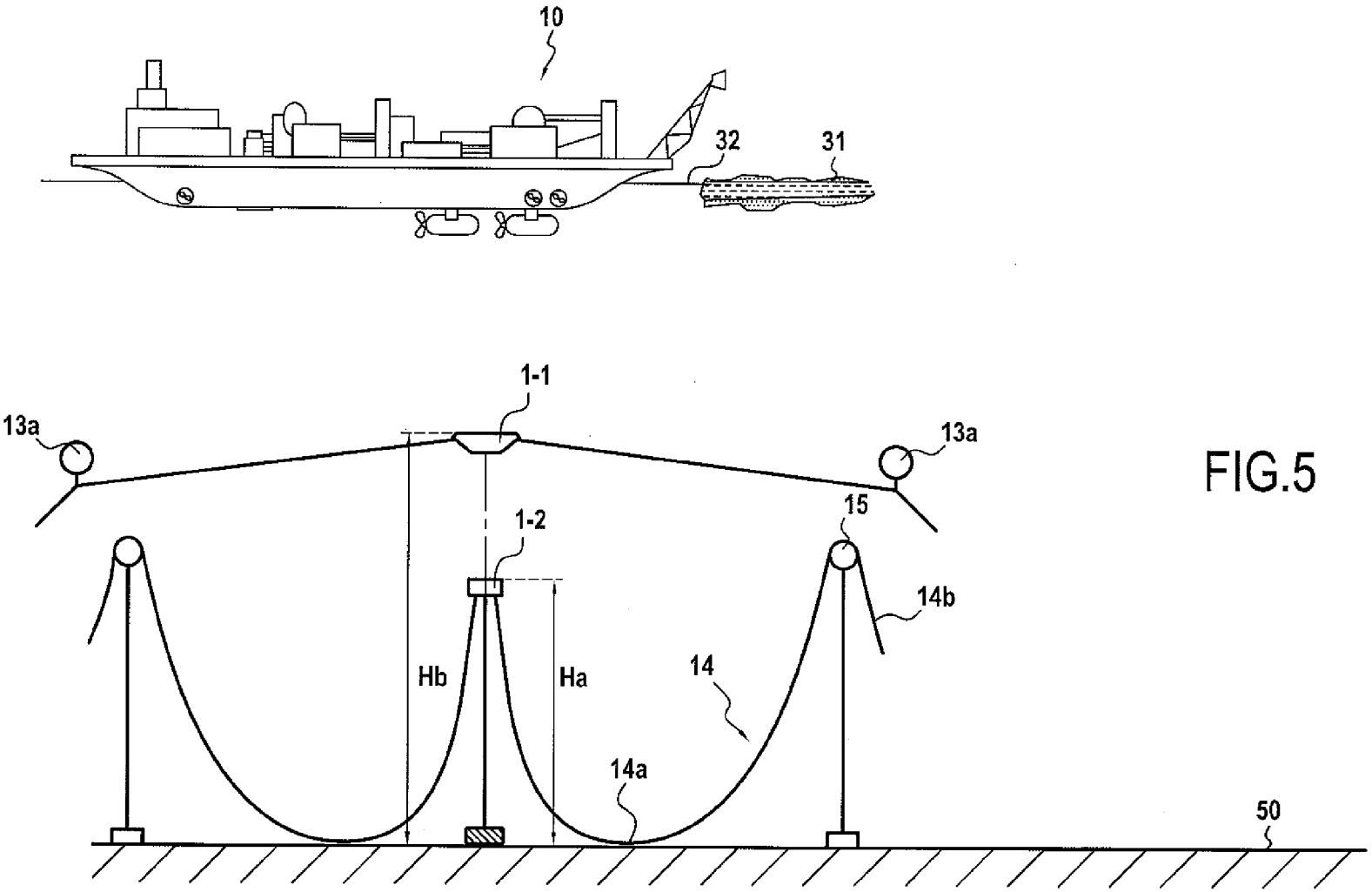
FIG. 5 is a side view of an FPSO returning to a position vertically above said first and second buoys in order to reconnect with said first buoy having the anchor lines 13, and then with said second buoy secured to said first bottom-to-surface connection pipes of the flexible pipe type.

FIG. 5 is a side view of an FPSO taking up a position vertically above the first and second buoys that are stabilized respectively at heights Hb and Ha above the sea bottom 50, with the FPSO successively recovering and connecting to the first mooring buoy 1-1 and then the second buoy 1-2.

Figure 6:
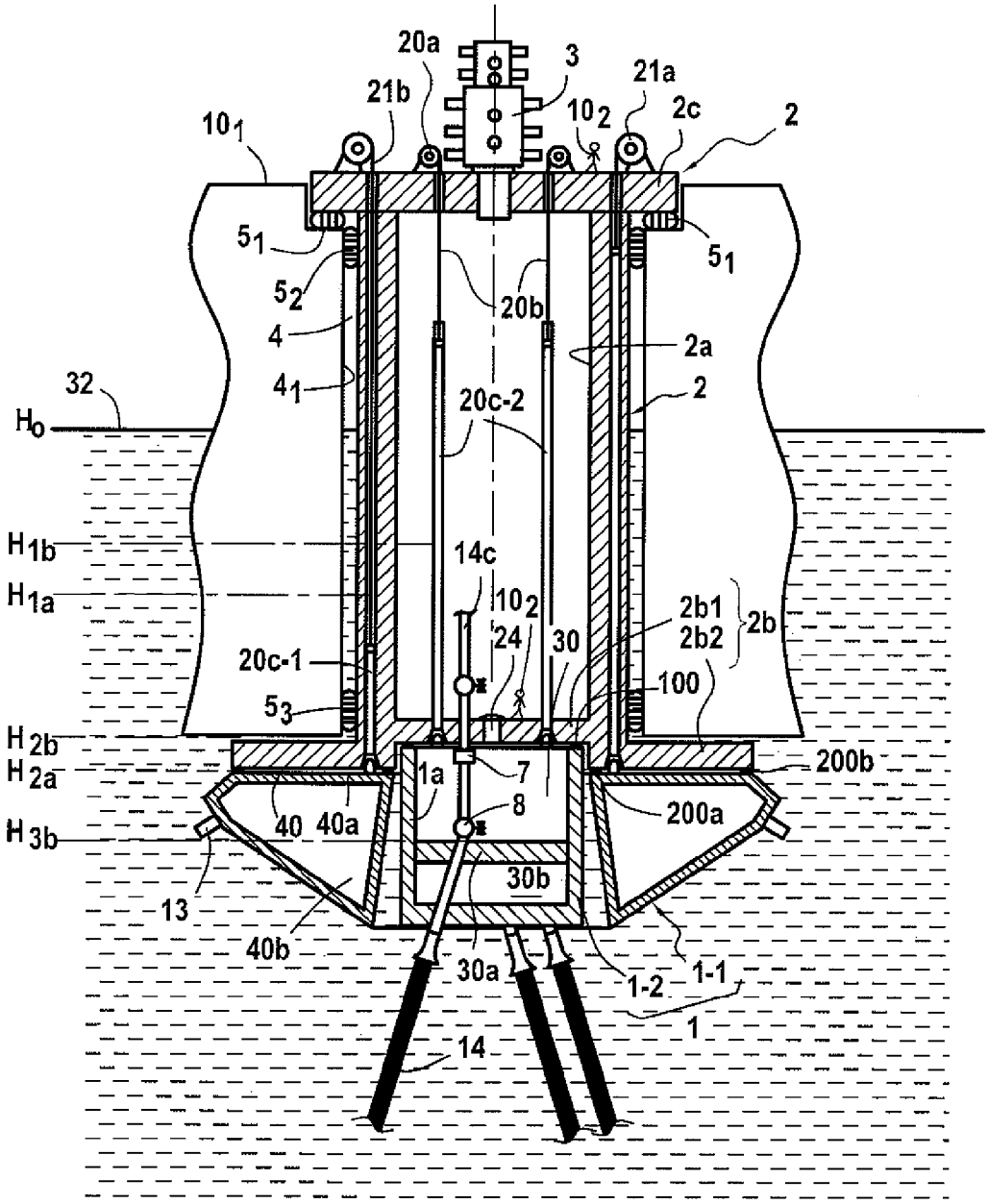
FIG. 6 is a section view and a side view showing the turret passing right through the FPSO, the bottom wall of the turret supporting a said annular first buoy to which the anchor lines are moored and a second buoy 1-2 including a valve chamber in which said first bottom-to-surface connection pipes are connected, said valve chamber in continuous operation being made accessible to personnel $\mathbf{10}_2$ since it is then at atmospheric pressure.

FIG. 6 is a section view and side view of the mooring device 1. It comprises two buoys 1-1 and 1-2 disposed coaxially one within the other about the axis ZZ' of the bottom wall 2*b* of said turret, a first buoy 1-1 being an annular buoy to which said anchor lines 13 are moored, and said annular buoy having a central orifice 1-3 containing a second mooring buoy 1-2 to which said first bottom-to-surface connection pipes 14 are moored, said second mooring buoy 1-2 having a top tubular wall 1*a*, referred to below as the valve chamber, with said valves 8 and connectors 7 at the top ends of said first connection pipe 14 being contained therein.

Said mooring device 1 is reversibly connected to a turret 2. Said turret comprises a watertight tubular structure 2 of circular section about said vertical axis ZZ', having a bottom wall 2*b* assembled in watertight manner to the bottom end of the tubular side wall 2*a* of said watertight tubular structure. Said turret 2 extends within a cavity 4 passing through the full height of the hull of the floating support. Said turret is mounted to rotate relative to said hull via three rolling bearings $\mathbf{5}_1$, $\mathbf{5}_2$, and $\mathbf{5}_3$, one of which, $\mathbf{5}_1$, is situated above the water line 32 and/or clear of the water. These rolling bearings allow said floating support to pivot about a substantially vertical axis ZZ' of said turret and of said cavity, without causing said mooring device to turn about said vertical axis ZZ'.

Second connection pipes 14*c* extend between the top ends of said first bottom-to-surface connection pipes 14 to which they are connected, and the deck of the floating support $\mathbf{10}_1$. Said second connection pipes 14*c* pass in watertight manner through the bottom wall 2*b* of the turret 2 and extend up within the cavity 4 to a coupling 3 for coupling a plurality of said second pipes 14*c*, said coupling 3 being secured to the floating support on the deck $\mathbf{10}_1$ of said floating support. Said coupling 3 is of the rotary joint coupling type that is rotatably mounted on the deck so as to allow said floating support to pivot without said coupling turning. The bottom ends of said second connection pipes at the underface of said bottom wall of the turret are connected to the top ends of said first connection pipe 14 via connectors 7 that co-operate with isolating valves 8.

Sea water is present inside said cavity 4 of the FPSO and outside the turret.

The turret 2 includes at its top end a top platform 2*c* of greater diameter than the tubular side wall 2, said platform having its peripheral portions that project beyond the tubular side wall 2 bearing against the step 10*a* at the top end of the cavity 4.

The mooring system at the turret has three rolling bearings, namely:

a top support bearing $\mathbf{5}_1$; and a top lateral guide bearing $\mathbf{5}_2$; and a bottom lateral guide bearing $\mathbf{5}_3$.

Said bearings $\mathbf{5}_1$, $\mathbf{5}_2$, $\mathbf{5}_3$ are friction bearings or rolling bearings, and they are preferably rolling bearings. More particularly, they may comprise rollers or wheels interposed between:

the inside wall $\mathbf{4}_1$ of the cavity 4 and the outside surface of the tubular side wall 2, for the lateral guide rollers or the wheels $\mathbf{5}_2$ and $\mathbf{5}_3$; and the step 10*a* and the top platform 2*c* of the turret 2, for the support bearing $\mathbf{5}_1$.

It can be understood that at least at said bearings, said tubular structure 2 and said cavity inside wall $\mathbf{4}_1$ are of circular section. The rollers or wheels of the bottom and top lateral guide bearings $\mathbf{5}_2$ and $\mathbf{5}_3$ are more particularly disposed with their axes of rotation in a vertical position. For the top support bearing $\mathbf{5}_1$, said rollers or wheels are disposed with their axes of rotation in a horizontal position bearing against the step 1*a*, with the platform 2*c* resting on the top edges of said rollers $\mathbf{5}_1$.

By way of example, in order to install a large number of pipes for gas, crude oil, hydraulic umbilicals, and electric cables, e.g. 36 or 48 pipes 14, together with all of their safety and control elements, the outside diameter of said tubular structure of the turret 2 may exceed 25 m, and more particularly its diameter may be 10 m to 20 m, and its wetted height is generally greater than 20 m, possibly being as much as 25 m or even more when the hull of the floating support extends over a height of 50 m, as sometimes happens.

The connection/disconnection system for connecting/disconnecting said first and/or second mooring buoy 1-1, 1-2, as the case may be, relative to said bottom wall 2*b* of the turret enables each of said first or second mooring buoys to be connected/disconnected respectively and independently of each other.

The bottom wall 2*b* of said turret comprises:

a circular central portion 2*b*1 assembled in watertight manner with said tubular side wall 2*a* of said turret inside it and above the bottom end 2*c* of said tubular side wall; and an annular peripheral portion 2*b*2 surrounding said central portion 2*b*1, being assembled in watertight manner to the bottom end 2*c* of said tubular side wall 2*a* or to the outside face of said tubular side wall of the turret, being offset downwards relative to said central portion 2*b*1 so that the bottom ends of said second connection pipes 14*c*, preferably including connector portions 7*b* and located beside the underface of said central portion 2*b*1 of the bottom wall 2*b*, are situated above the top end 2*c* of the tubular side wall of the watertight tubular structure of the turret 2.

Two coaxial gaskets 200*a* and 200*b*, preferably O-rings, are situated on the top face 40*a* of said first annular buoy 1-1, said gaskets being coaxial relative to the axis ZZ' of the central orifice 1-3 of said first buoy, and defining a first watertight chamber or interstitial annular chamber 40 between the peripheral portion 2*b*2 of the bottom wall 2*b* of said turret and the top face 40*a* of said first buoy, when said top face and of first buoy 1-1 is pressed against the bottom wall of said turret.

The FPSO is in cold water in which icebergs or pack ice 31 of large area and considerable thickness can be present floating on the surface of the sea 32. In certain extreme conditions, such as storms or when the pack ice is so thick that the ice breaker-shaped bow of the ship cannot break it as it advances, it is necessary to disconnect the FPSO to allow it to take shelter while waiting for the situation to return to normal. For this purpose, said second buoy is disconnected so as to lower the said first pipes at a certain depth. And the first buoy, commonly referred to as a "spider buoy" is disconnected.

More particularly, the internal buoyancies of said first and second buoys, i.e. the volume of the empty annular caisson 40*b* inside the first buoy 1-1 and the volume of the caisson 30*b* at the underface of the valve chamber 30 of the second buoy, are adjusted in such a manner that said first and second buoys stabilize at respective heights Ha and Hb above the sea bottom, e.g. corresponding to depths of 50 meters (m) to 100 m below the surface of the sea 32, thereby sheltering all of the anchor lines and the flexible pipes, as shown in particular in FIG. 5.

Nevertheless, in the invention, it is possible to disconnect the second buoy on its own so as to shelter the pipes 14 without disconnecting the first buoy and thus leaving the floating support anchored, as shown in FIG. 3.

As shown in FIG. 2, when the ship is severely stressed, either by pack ice or by swell, wind, or current, its anchor system 13 connected to the annular mooring buoy $\mathbf{1}_1$ keeps it in position. Given the large dimensions of the FPSO, the reaction forces of its anchoring give rise to considerable variations in horizontal tension F at the base of the turret, possibly reaching 5000 t to 7500 t for pack ice advancing perpendicularly to the side of the FPSO, and reaching 1500 t to 3000 t under extreme conditions of swell, wind, and current. These horizontal forces are transmitted directly by said annular mooring buoy to said base of the turret.

For greater clarity, FIGS. 6 to 11 show the second buoy 1-2 with only one said second pipe 14*c* passing through the inside of the turret from a female portion 7*b* of the automatic connector 7 at the underface of the bottom wall 2*c* of the turret.

Figure 7:
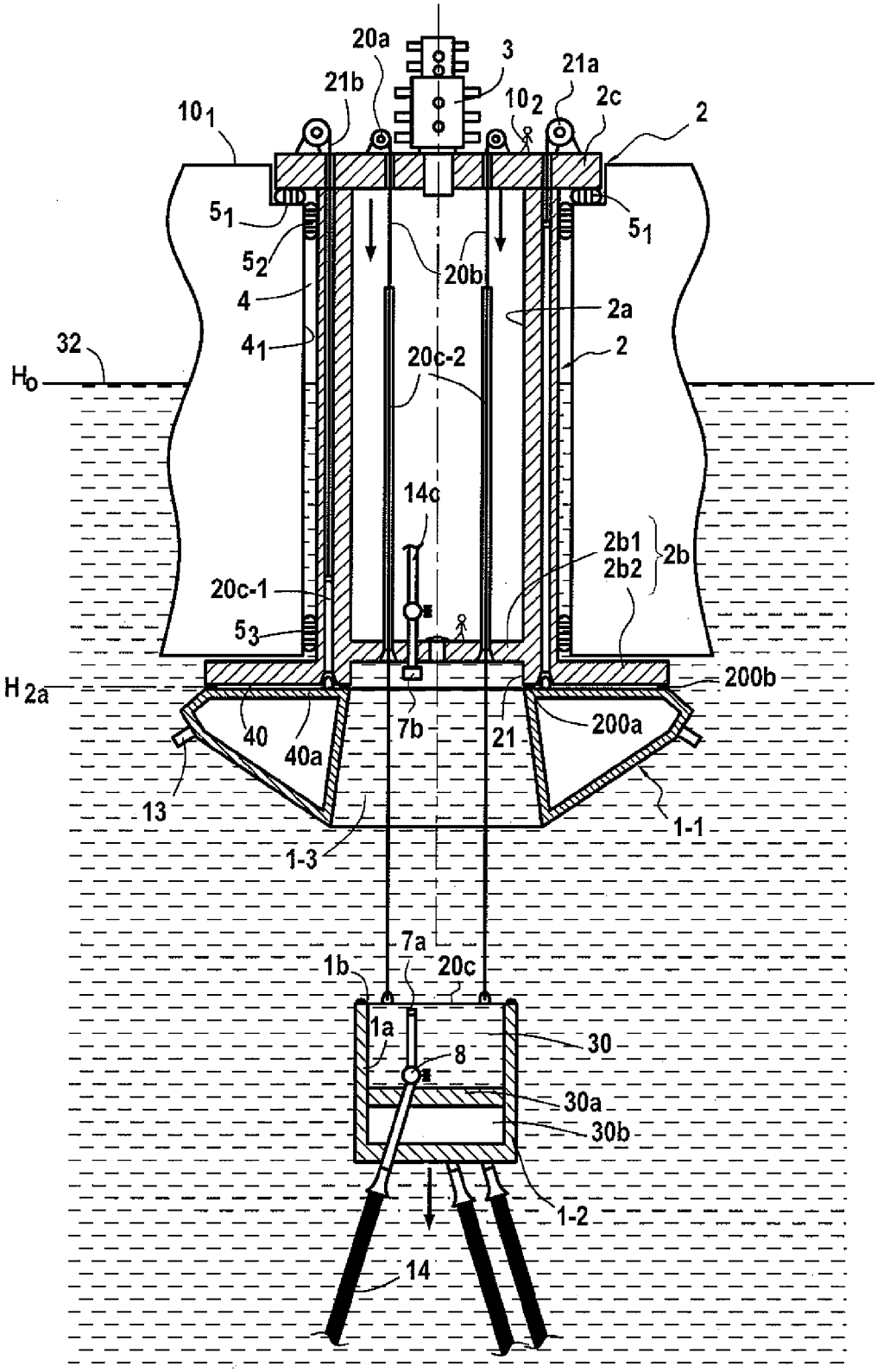
FIG. 7 is a section view and a side view of disconnecting said second buoy from the turret by flooding said valve chamber with sea water, during a casting-off procedure accompanied by handling cables 20*b*, 21*b;*

As shown in FIG. 7, the second buoy is handled by cables 20*b*, at least two cables and preferably three cables, and preferably regularly and uniformly spaced apart inside said turret against the inside cylindrical surface of the wall of the tubular structure 2, and are connected to winches 20*a* that are secured to the turret and that are installed at the top portion thereof well above the water line 32, and preferably on the platform 2*c*. Said cables 20*b* pass through a guide tube 20*c*-2, which projects by several meters, e.g. 5 m, from the maximum level of swell that might strike the side of the ship, said maximum level being well above the level of the sea at rest, as represented by reference 32 in FIG. 7. Said guide tube 20*c*-2 extends vertically downwards and passes in watertight manner through the central portion 2*b*1 of the bottom wall 2*b* of the turret 2. Thus, the level of sea water inside the guide tubes 20*c*-2 remains substantially the same as at the side of the ship, i.e. at the level $H_0$ that corresponds, in said figure, to sea level 32. In the event of a large amount of swell or a storm, the level of water in said guide tube 20*c*-2 cannot reach the top of said tube 20*c*-2 and there is no risk of sea water penetrating into the inside of the turret 2.

The tubular side wall 2*a* of the turret has guide tubes 20*c*-1 passing through its structure, preferably at least three such guide tubes that are regularly distributed and that extend from the platform 2*c* to the bottom end of the tubular side wall 2*a* by passing through the peripheral portion 2*b*2 of the bottom wall 2*b* of the turret. Within these guide tubes there extend cables 21*b* secured at their top ends to winches 21*a* supported by the platform 2*c* and secured at their bottom ends to the plane top face 40*a* of said annular first buoy.

The first mooring buoy is thus handled by means of the cables 21*b*, there being at least two such cables, and preferably three such cables that are preferably regularly and uniformly distributed within the tubular wall 2*a* of said turret.

Figure 13:
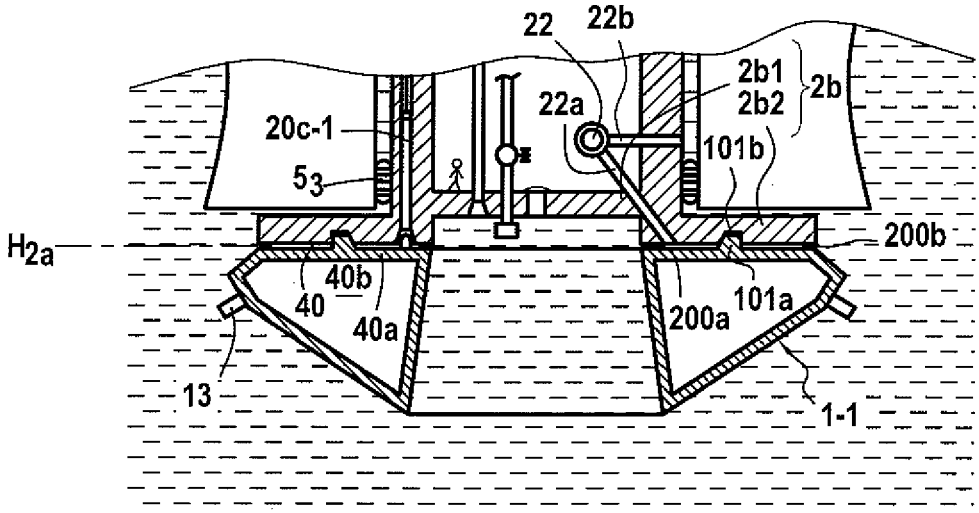
FIG. 13 is a section view and a side view of the device using a bilge pump to deballast the top portion of the chamber of the first buoy.

With the first annular buoy 1-1 being in a rest position at a height Ha above the sea bottom above the sea bottom, and the second buoy 1-2 being in a rest position at a height Hb, as shown in FIG. 5, the FPSO takes up position substantially vertically above both buoys and a remotely-operated vehicle (ROV) is used to connect the ends of the cables 21*b* to said first buoy 1-1 once they have been lowered to the desired depth by being unwound from the winches 21*a*. The first buoy is then raised towards the bottom 2*b* of the turret by winding in all of the winches synchronously until the top portion of the buoy comes into contact with the bottom portion 2*b*2 of the turret. The first chamber 40 is then deballasted as shown in FIG. 13 by using a pump 22, and said first buoy is then secured to the turret by the buoyancy thrust acting on the surface defined between the two gaskets 200*a* and 200*b*, since said first chamber 40 is then substantially at atmospheric pressure.

In the same manner, with the second buoy 1-2 being in its rest position at an altitude Hb above the sea bottom, the ROV connects the top edge 1*b* of said second buoy 1-2 to the bottom ends of cables 20*b* that have been lowered to the desired depth by being unwound from the winches 20*a*. The second buoy is then raised towards the bottom of the turret by all of the winches winding-in synchronously until the top portion of the buoy comes into contact with the bottom portion of the turret. The valve chamber 30 is then deballasted as shown in detail in FIG. 10 using a pump 22, and said buoy is then secured to the turret by the buoyancy thrust acting on the surface defined by the gasket 100, since said chamber 30 is then substantially at atmospheric pressure.

The ways in which the first and second buoys are connected and disconnected are similar, and the description below is more detailed for the second buoy.

The top portion of the second buoy 1-2 is constituted by a top tubular wall 1*a*, preferably of circular section, defining a first chamber or valve chamber 30 containing the top ends of the first pipe 14 that pass in watertight manner through the bottom 30*a* of the chamber 30, and through the buoyancy caisson 30*b* situated under said valve chamber 30. Said top ends of the first pipes 14 are fitted with valves 8 and/or male or female portions 7*a* or 7*b* of automatic connectors 7. The valves 8 and the male portions 7*a* of automatic connectors 7 at the top ends of the first pipe 14 are supported by the bottom wall of the valve chamber 30*a*.

The circular sealing gasket 100, preferably an O-ring, is pressed against the top edge 1*b* constituting the edge face of the tubular top wall of the second buoy 1-2.

The circular elastomer gasket 100 secured to the buoy 1-2 is compressed between the underface of the turret and the top portion of the second buoy, with a guide member 101 secured to said second buoy limiting the extent to which said gasket can be compressed and serving to transfer vertical loads by buoyancy between said second buoy and the turret.

These guide members 101 are pressed against the outside surface of the tubular wall 1*a* and they extend beneath it, i.e. below the level of the underface of the bottom wall 2*c* of the tubular structure 2 so as to take up the horizontal forces to which the mooring buoy 1-2 is subjected.

The bottom end 27 of the tubular side wall 2*a* of the turret beneath the central portion 2*b*2 of the bottom wall acts as guide means 27 for centering the second buoy relative to the turret, thereby facilitating connection of the male and female portions 7*a* and 7*b* of the automatic connectors.

The bottom end 27 of the tubular side wall 2*a* of the turret thus serves to take up the horizontal forces to which the mooring buoy 1-2 is subjected.

Figure 10:
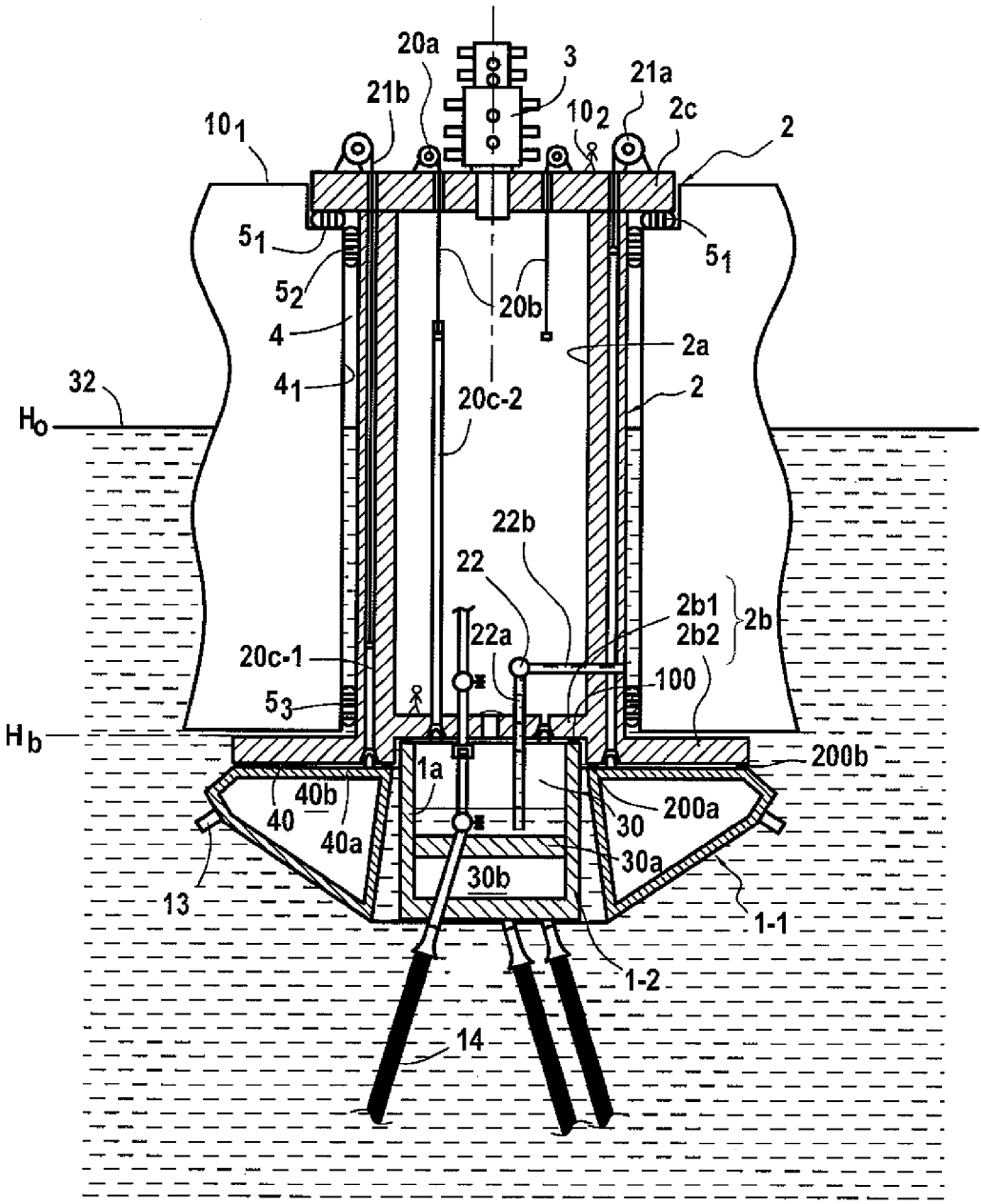
FIG. 10 is a section view and a side view of the turret showing deballasting, by means of the bilge pump, of the top portion of the second buoy corresponding to the valve chamber 30.

When docking of the second buoy 1-2 against the turret is completed, tension is maintained in the cables 20*b*, 21*b* and the valve chamber 30*a* is deballasted as described in detail with reference to FIG. 10.

For this purpose, a pump 22 sucks out the water through a suction pipe 22*a* that passes in watertight manner through the bottom 2*c* of the turret and the water is rejected to the sea via a delivery pipe 22*b* that passes in watertight manner through the turret 2. At the beginning of pumping, the water inside the guide tubes 20*c*-1 is at the level $H_0$, corresponding substantially to sea level, but once a few hundred liters have been pumped out, the water drops down to the level $H_{1b}$, since the diameter required for the pipes is associated with the diameter of the hoist cables 20*b* and is advantageously kept to a minimum. By way of example, a guide tube having an inside diameter of 300 millimeters (mm) and a height $H_0-H_2b$ of 20 m and containing a hoist cable with a diameter of 150 mm corresponds to a volume of water that is about 1 $m^3$, i.e. a total volume of about 4 $m^3$ for a four-strand hoist system. A deballasting pump that operates at 500 cubic meters per hour ($m^3$/h) can thus empty the entire height of said guide pipes in about 30 seconds (s) and can then begin to empty the valve chamber which has a volume of about 2000 $m^3$, if the chamber has a height of 5 m and a diameter of 22.5 m.

Thus, after the first 4 $m^3$ of water has been removed, i.e. after about 30 seconds, the second buoy is pressed against the underface of the turret with an upwardly-directed vertical force corresponding to the section of the inside surface $S_b$ that is defined by the gasket 100 multiplied by the hydrostatic pressure that corresponds to the level $H_{2b}$, i.e. that corresponds to buoyancy thrust, and thus to the weight of the volume V of water, where $V_b=S_b\times(H_0-H_{2b})$ By way of example, the above-described annular buoy has a valve chamber with a diameter of 22.5 m at the gasket 100 and is situated at a depth $H_{2b}$=20 m, thus corresponding substantially to a pressure of 2 bars, so it is pressed against the turret with an upwardly-directed vertical force of about 8000 t. When the valve chamber 30 is empty, it is at atmospheric pressure and is made accessible via a manhole 24 having a cover 24*a* that is watertight in the closed position when the second buoy is disconnected, or while the valve chamber is being emptied or filled.

Figure 14:
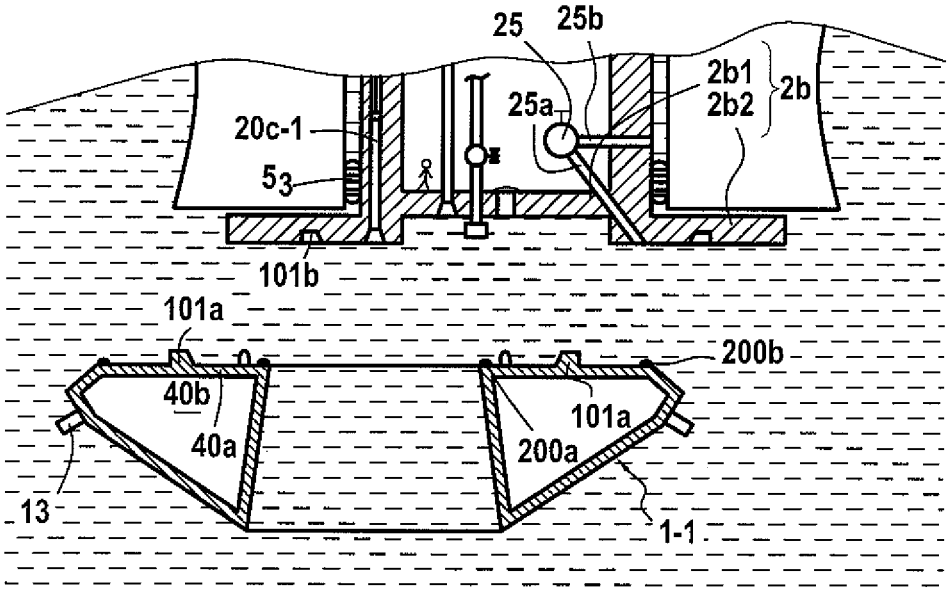
FIG. 14 is a section view and a side view of the device for flooding the chamber of the first buoy, after said second buoy has been disconnected.

Once the valve chamber 30 has been emptied, the hoist cables are no longer necessary and they are preferably disconnected so as to make it easier subsequently to cast off the second buoy, should that be necessary. Advantageously, a safety latch device as shown in FIG. 14 is placed against the underface of the turret and is constituted, for example, by a movable hinge portion 102 secured to said turret underface on co-operating with a guide member 101 secured to the annular buoy, said guide member being common with the abutment limiting flattening of the elastomer gasket 100, for example. Thus, in the event of the valve chamber being flooded, the loss of buoyancy of the annular buoy is compensated by the safety latches and there is no risk of said annular buoy being cast off in unintended and destructive manner.

Figure 11:
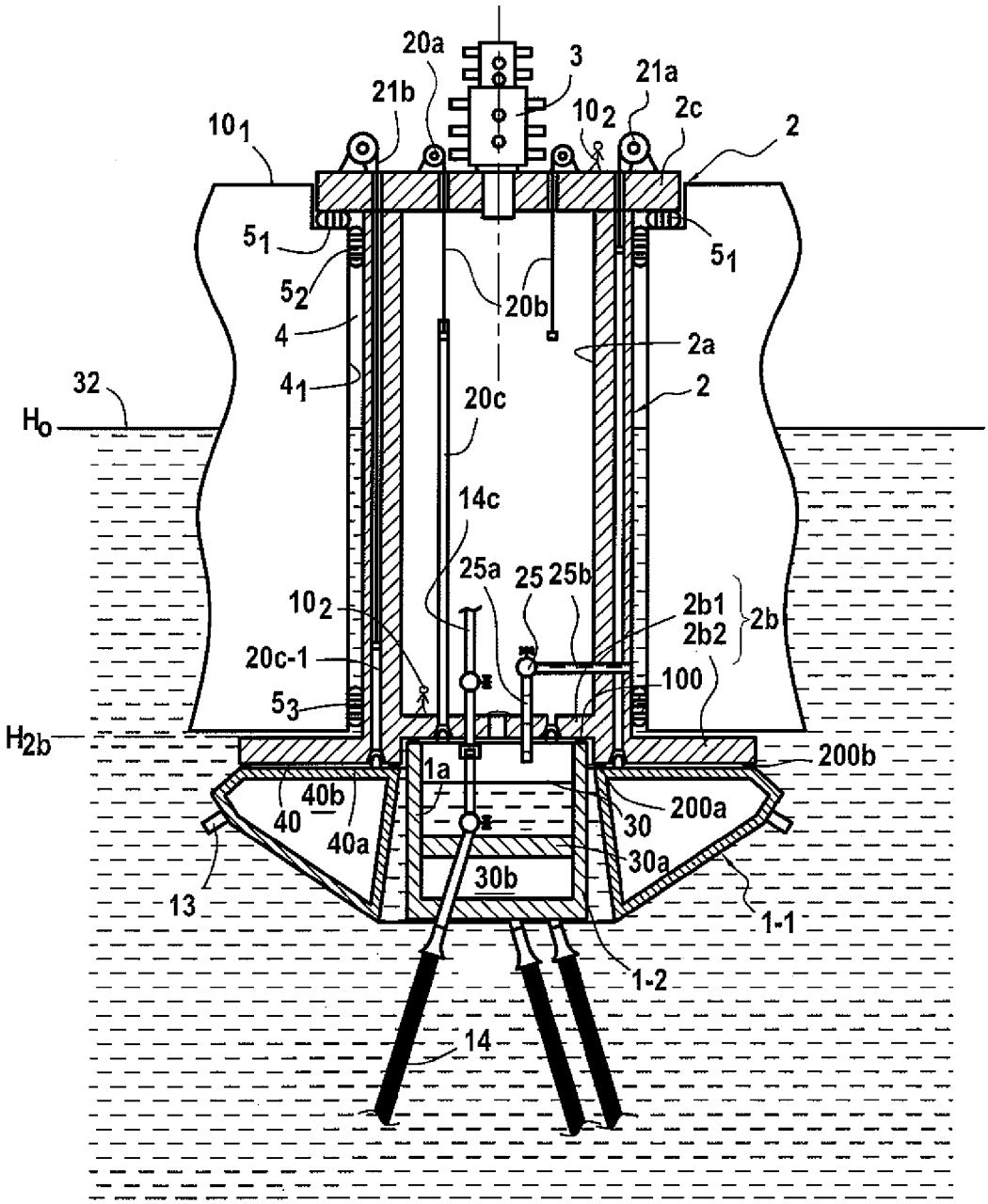
FIG. 11 is a section view and a side view of the initial step of disconnecting the second buoy relative to the turret by flooding the valve chamber with sea water, during the casting-off procedure.

If it is necessary to disconnect the second buoy of the FPSO, e.g. because of a storm, an iceberg, or pack ice threatening the installation as a whole, the disconnection is advantageously performed using the following preferred procedure that is described with reference to FIGS. 6 and 12:

the access hatch 24*b* to the valve chamber is closed in watertight manner; and the hoist cables 20*b* are disconnected from the annular buoy and, where appropriate, fully extracted from the guide tubes 20*c*-2, with the safety latches 102 still being engaged, and the valve 25 is opened, as shown in FIG. 11, putting said valve chamber into communication with the sea via filler pipes 25*a*-25*b* that pass respectively through the tubular side wall 2 in the bottom portion of the turret and through the central portion 2*b*1 of the bottom wall 2*b* of the turret, thereby beginning to fill the valve chamber, with the guide tubes 20*c*-2 acting as vents so as to maintain the valve chamber substantially at atmospheric pressure throughout said filling operation; and filling is stopped by reclosing the valve 25 when the valve chamber 30 is completely full, this representing a volume of sea water equal to about 2000 $m^3$ in the above-described example, i.e. when the level of the water inside the valve chamber reaches the $H_{2b}$ mark.

In this position, the second buoy is still held in position by hydrostatic thrust (F=the weight of the volume of water $V_{2b}=S_b\times(H_0-H_{2b})$), and the casting-off process can be reversed merely by emptying the chamber as described above. During or prior to this filling stage that may last for 10 minutes (min) to 45 min, depending on the number of valves 25 and of filler pipes 25*a*-25*b*, and depending on their respective diameters, it is advantageous to depressurize all of the flexible pipes 14 down to the well heads, and more particularly the gas pipes that are under very high pressure, with the gas therefrom being sent to the flare tower of the FPSO in order to be burned off.

When disconnection is confirmed in definitive manner:

the safety latches 102 are unlocked by making them pivot from their engaged positions 102*a* to their retracted positions 102*b*; and at least one of the valves 25 is opened wide so as to finish off filling the guide tubes 20*c*, with this representing only a small volume, of the order of a few $m^3$ in the above-described example.

As soon as the water reaches the level $H_{1b}$, the buoyancy of the second buoy is reduced from the value $F_{3b}$=the weight of the volume of water $V_{3b}=S_b\times(H_0-H_{3b})$ with $H_3$b=the level of the bottom wall 30*a* of the valve chamber 30, up to the value $F_{1b}$=the weight of the volume of water $V_{1b}=S_b\times(H_0-H_{1b})$ When the dead weight of the assembly constituted by the second buoy, the flexible pipes, exceeds the value $F_{1b}$, the second buoy naturally begins to separate from the turret and as a result said second buoy begins to move downwards, the gasket 100 no longer provides sealing and allows sea water to penetrate at an almost infinite rate. The second buoy is thus immediately at a hydrostatic level that corresponds to sea level, i.e. $H_0$, and said second buoy drops downwards under considerable force corresponding to its dead weight, i.e. about 500 t to 1500 t, thereby releasing the FPSO from its anchoring on the turret, in quasi-instantaneous manner.

Between being triggered and actually taking effect, this final stage requires only 3 $m^3$ to 4 $m^3$ of water to be transferred in the above-described example for the purpose of filling the guide tubes 20*c*-2 that act as vents, so it takes only a few seconds, or at worst only a few tens of seconds. Once the hydrostatic level $H_{1b}$ is reached, the second buoy begins to move downwards, but the gasket 100 remains in a compressed state and continues to provide sealing. In order to continue the casting-off process, it is appropriate to continue to allow water to enter until the gasket is uncompressed and starts to allow sea water to go past, thereby causing the second buoy to be cast off suddenly. By way of example, for a gasket compressed over a thickness of 25 mm, and in the above-described example of a valve chamber having a diameter of 22.5 m, this requires about 10 $m^3$ of additional sea water, and thus does not greatly increase disconnection time.

Figure 12:
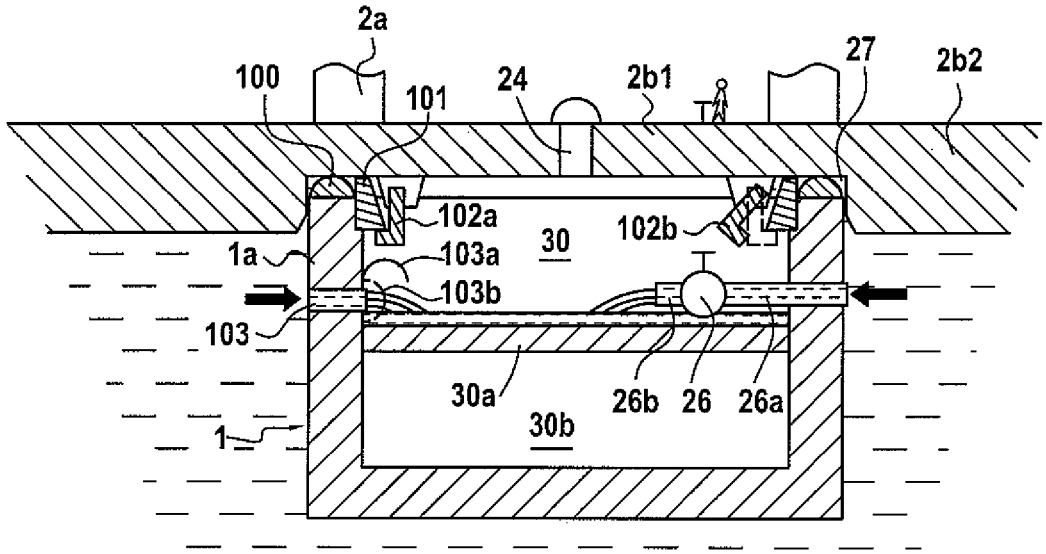
FIG. 12 is a section view and a side view of the fastener elements between the underface of the turret and the top portion of the second buoy, and also of the means for flooding the valve chamber with sea water.
Figure 15:
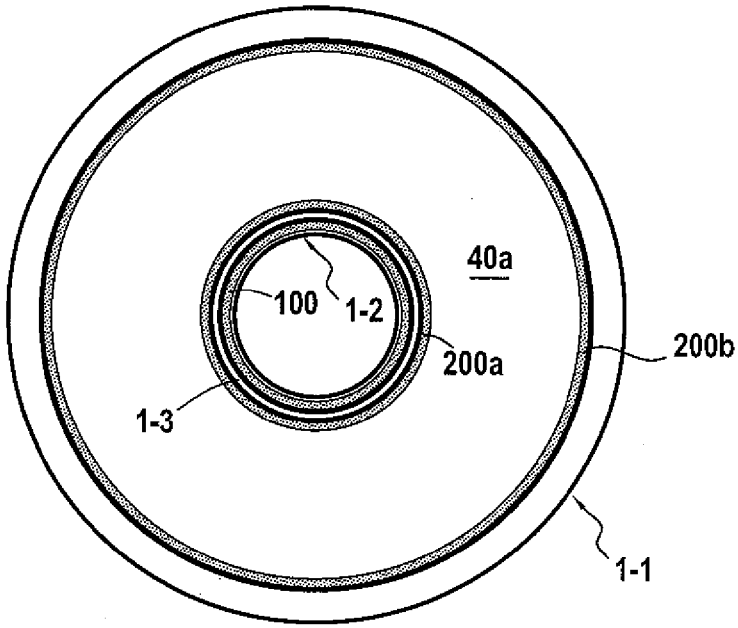
FIG. 15 is a plan view of the first and second buoys when in a coaxial configuration.

It is also possible to fill the valve chamber 30*a* using lateral valves 26 and filler pipes 26*a*-26*b* passing through said top tubular wall 1*a* of the second mooring buoy 1-2, as shown in FIG. 12.

In order to obtain quasi-instantaneous disconnection, it is advantageous to make use of a watertight hatch in the top tubular wall 1*a* of the valve chamber 30, which hatch is of large dimensions 103 that is held in a closed position 103*a* in normal operation and during the preliminary disconnection stage by a trigger device or by explosive bolts (not shown), and that is subsequently remotely actuated in known manner to release said watertight hatch, which allows sea water to pass freely once it is in the position 103*b*. Casting off then takes place almost instantaneously.

In the above description, said top tubular wall 1*a* of the second mooring buoy is described as being defined by a cylindrical surface having a vertical axis ZZ', and preferably of circular section. However, it can be understood that said top tubular wall 1*a* may be defined by a surface of revolution having a vertical axis ZZ' traced by a straight generator line that is inclined relative to the axis ZZ', said top tubular wall then presenting a shape that is frustoconical, or said generator line may be curved, the essential point being to define a side wall having a top edge 1*b* that is suitable for coming into contact with the underface of the central portion 2*b*2 of the bottom wall 2*b* of the turret 2 and also to have a bottom end that is assembled in watertight manner to the periphery of the bottom wall of the chamber 30 so as to define a valve chamber 30*a* that is watertight when the top edge of the side wall of said valve chamber comes into contact with the central portion 2*b*1 of the bottom wall 2*b* of the turret 2.

In the description of the various figures, the winches 20*a*-21*a* are shown installed at the level of the deck of the FPSO and the corresponding hoist cables 20*b*-21*b* pass along the guide tubes 20*c*-1, 20*c*-2, which pipes also act as vents, however it would remain within the spirit of the invention if the winches were to be incorporated in the structure of the turret at the bottom thereof. The winches would then be directly in the water and the cables would be connected directly to the buoy: at least one pipe 20*c*-1, 20*c*-2 would then need to be provided to act solely as a vent.

The system and the method for connecting/disconnecting said first buoy 1-1 is similar to those described above for the second buoy.

To connect the first buoy 1-1, the pump means co-operate with a suction pipe 22*a* passing through the peripheral portion 2*b*2 of the bottom wall 2*c* and a delivery pipe 22*b* passing through the tubular side wall 2*a* and delivering into the cavity 4, serving to empty the interstitial chamber 40 between the two gaskets 200*a* and 200*b* defining said chamber 40, once the first buoy is pressed against the bottom wall of the turret.

The two elastomer gaskets 200*a*-200*b* secured to the first annular buoy 1-1 are compressed against the underface of the turret and the top portion of the first buoy.

Guide members 101*a*, 101*b* comprise male portions 101*a* secured to the top face 40*a* of the first buoy and co-operating with complementary female portions 101*b* into which they are suitable for being wedged formed in the underface of the peripheral portion 2*b*2 of the bottom wall 2*b* of the turret.

Similarly, the abutments or guide members 101*a*, 101*b* may serve to limit the extent to which the gaskets 200*a* and 200*b* are flattened, and these guide members may co-operate with safety latches (not shown) for securing the first buoy to the peripheral portion 2*b*2 of the bottom wall 2*b* of the turret.

These guide members 101*a* and 101*b* act as means for centering the first buoy relative to the bottom wall of the turret and serve to take up at least some of the horizontal forces to which the first buoy is subjected.

In order to disconnect the first buoy 1-1, a valve 25 and pipes 25*a*, 25*b* pass through the side walls 2*a* of the turret and serve to fill the chamber 40 with water taken from inside the cavity 4.

For both buoys, the buoyancy thrust acts on the area defined respectively by the sealing gasket 100 for the second buoy, and defined by the gaskets 200*a*-200*b* for the first buoy. The vertically upward thrust is a function of the difference $H_0-H$, where H is the free water level within the guide tubes 20*c*-1, 20*c*-2.

For the first buoy, as shown in FIG. 6, the level $H=H_{1a}$ corresponds to equilibrium between the upward buoyancy and the downward dead weight of the mooring buoy 1-1 together with its anchoring system. Thus, when connecting said first buoy, the pump 22 causes the water level in the guide tubes 20*c*-1 to drop very quickly, and as soon as the level $H_{1a}$ is reached, said buoy 1-1 is pressed against the underface of the turret 2. Continued pumping then has the effect of increasing the buoyancy thrust, and the safety factor of the system is then a function of the height $H_{1a}-H_{2a}$.

In the same manner, when disconnecting the first buoy in calm weather, so long as the level of water inside the guide tube 20*c*-1 remains below the level $H_{1a}$, said buoy remains pressed against the underface of the turret, but it is cast off as soon as said level $H_{1a}$ is exceeded and comes closer to the surface. Under extreme conditions, as shown in FIGS. 2 and 3, disconnection will take place at a level H that lies between the level $H_{1a}$ and the level $H_{2a}$.

The same applies for the second buoy which, in calm weather, is connected or disconnected at a level $H_{1b}$, while under extreme conditions it is cast off at a level H lying between the level $H_{1b}$ and the level $H_{2b}$. By way of example, a first buoy 1-1 presenting an inner peripheral gasket 200*a* with a diameter of 25 m and an outer peripheral gasket 200*b* with a diameter of 42 m, associated with a value for $H_{2a}$ of 22 m, is subjected to an upward buoyancy thrust of about 20,000 t when the plane of the gasket lies at a depth of 20 m.

The invention claimed is:

1. An oil production floating support, comprising:

a hull;

a deck;

a mooring device for mooring anchor lines at the bottom of the sea and first bottom-to-surface connection pipes extending from said mooring device where they are moored down to the bottom of the sea, said mooring device comprising at least one annular mooring buoy, said mooring device being connected reversibly to a turret; and said turret comprising at least one watertight tubular structure having a bottom wall assembled in watertight manner to the bottom end of a tubular side wall of said watertight tubular structure, said turret extending in a through cavity passing within the hull of the floating support, said turret being rotatably mounted relative to said hull by means of at least one rolling or friction bearing to allow said floating support to turn about a substantially vertical axis ZZ' of said turret and of said cavity without causing said mooring buoy to turn relative to the same vertical axis ZZ'; and second connection pipes between the top ends of said first bottom-to-surface connection pipes to which they are connected and the deck of the floating support, said second connection pipes passing through the bottom wall of the turret in watertight manner and rising within the cavity to a coupling for coupling a plurality of said second pipes, said coupling being secured to the floating support level with the deck of the floating support, said coupling being of a rotary joint coupling type, being rotatably mounted so as to allow said floating support to turn without turning said coupling, the bottom ends of said second connection pipes under said bottom wall of the turret being connected to the top ends of said first connection pipes by means of connectors co-operating with valves;

wherein:

said mooring device comprises two mooring buoys disposed coaxially one relative to the other and about the axis of the bottom wall of said turret, a first buoy being an annular buoy having said anchor lines moored thereto, and said annular first buoy including a central orifice containing a second mooring buoy having said first bottom-to-surface connection pipes moored thereto, said second mooring buoy having a top tubular wall within which said valves and connectors are situated at the top ends of said first connection pipes; and said floating support includes a connection/disconnection system for connecting/disconnecting said first and/or said second mooring buoy(s) respectively relative to said bottom wall of the turret, enabling each of said respective first or second mooring buoys to be connected/disconnected independently of the other, the connection/disconnection system comprising:

two sealing gaskets on the top face of said annular first buoy, said gaskets being coaxial about the axis of the central orifice of said first buoy, defining a first watertight chamber or interstitial annular chamber between the bottom wall of said turret and the top face of said first buoy when said top face of said first buoy is pressed against the bottom wall of said turret; and said tubular top wall of said second buoy co-operating with the bottom wall of said turret to define a second watertight chamber referred to as the valve chamber, when a sealing gasket on the top edge of said tubular top wall of the second buoy is pressed against the bottom wall of said turret, against the underface thereof; and a plurality of hoist cables fastened to said mooring buoy; and at least two vent tubes extending vertically inside the turret from a level above a water line to the bottom wall of the turret through which they pass in watertight manner via each of said first and second chambers respectively; and pump means for pumping the water in each of said first and second chambers respectively when said first and second corresponding buoy is respectively pressed against the bottom wall of the turret; and the dead weight of said first mooring buoy and anchor lines and respectively the dead weight of said second mooring buoy and of said first bottom-to-surface connection pipes is less than the weight of the volume of water corresponding to the volume of said first and second chambers, where $Vi=Si\times(H0-H2i)$ in which:

H0 is the height of water at the water line;

H2*i* is the height of the top portion of the bottom wall of the turret defining said first chamber or said second chamber respectively;

Si is the area of the cross-section of said first chamber or of said second chamber respectively; and i=a for said first buoy and said first chamber and i=b for said second buoy and said second chamber.

2. The floating support according to claim 1, wherein said plurality of said hoist cables extends from winches located on the deck of the floating support or at the top of said turret, above the water line, said cables where appropriate extending inside a plurality of vent and guide tubes extending vertically inside the turret from a level above the water line down to the bottom of the turret through which they pass in watertight manner.

3. The floating support according to claim 1, wherein, for at least one of said first and second buoys, said connection/disconnection system includes at least three said cables and at least three said guide tubes, the bottom ends of said cables being fastened to the top face of said first buoy, or respectively to the top edge of said top tubular wall of said second buoy.

4. The floating support according to claim 1, wherein the diameter of said guide tubes and the immersion depths of the portion of the bottom wall of the turret on which said guide tubes rest, where i=a or b, are such that the inside volume of the guide tubes is less than 15 m3 for a turret having an immersed height H0–H2 within said cavity of at least 20 m.

5. The floating support according to claim 1, wherein said top tubular wall of said second buoy includes, at its bottom end, a bottom wall to which it is assembled in watertight manner, forming the bottom wall of the valve chamber supporting said valves and/or automatic connector portions, and said buoy includes, in its bottom portion, a buoyancy tank constituting a float against the underface of the bottom wall of the valve chamber.

6. The floating support according to claim 1, including at least one said pump, said pump co-operating with a suction pipe passing in watertight manner through said bottom wall of the turret, said suction pipe coming close to the wall of each of said first and second chambers when said first or second buoy is respectively in position pressed against said bottom wall of the turret, and said pump co-operating with a delivery pipe for each of said first and second chambers, each said delivery pipe opening out into said cavity.

7. The floating support according to claim 1, wherein the bottom wall of said turret comprises:

a central portion assembled in watertight manner with said side tubular wall of said turret inside it and above the bottom end of said side tubular wall, and a peripheral portion surrounding said central portion, said peripheral portion being offset downwards relative to said central portion in such a manner that the bottom ends of said second link pipes are situated above the bottom end of the side tubular wall of the watertight tubular structure of the turret.

8. The floating support according to claim 1, including reversible mechanical safety locking or retaining means for locking or retaining each of said first and second mooring buoys against the underface of the bottom wall of said turret.

9. The floating support according to claim 8, wherein each of said first or second mooring buoys includes abutments or protective guide members for limiting the flattening of said gaskets and for transferring vertical loads between said first or second buoy and the turret when said first or second buoy is pressed against the bottom wall of said turret, said annular gaskets being compressed between the underface of the bottom wall of said turret and said first or second mooring buoy, said protective guide member being suitable for co-operating with a hinged movable safety latch secured to the underface of the bottom wall of said turret, whereby said first or second mooring buoy is secured to said turret when said safety latch is engaged under said protective guide member.

10. The floating support according to claim 1, wherein said top tubular wall of the second buoy and/or the tubular side wall of the watertight tubular structure of said turret include(s) a filler valve co-operating with filler pipes for putting sea water into communication with the inside of said valve chamber.

11. The floating support according to claim 1, wherein the bottom wall of the turret includes an inspection hatch for inspecting said valve chamber.

12. A method of operating the floating support according to claim 1, wherein a said first or second mooring buoy is connected to the underface against the bottom wall of a said turret by performing the following steps:

a) immersing a said first or second buoy, said anchor lines or said first bottom-to-surface connection pipes being moored respectively thereto; and b) securing the bottom ends of hoist cables to said first or second buoy, respectively, said floating support being positioned in such a manner that said first or second buoy, respectively, is substantially on the vertical axis of said cavity; and c) actuating said winches to raise said first or second mooring buoy until said sealing gaskets for said first mooring buoy or said sealing gasket for said second mooring buoy is/are pressed against the underface of the bottom wall of said turret, thereby forming a said first or second chamber respectively that is filled with sea water, said guide tubes co-operating with said first or second chamber respectively being likewise filled with sea water up to a height H0 corresponding substantially to the level of the water surface at the water line; and d) pumping out the water from inside said first or second chamber respectively, using said pump means until the level of water in said guide tubes co-operating with said first or second chamber, respectively, is less than the height H1*i*, the height H1*i* being such that the buoyancy corresponding to the weight of the volume of water V1*i*=Si×(H0–H1*i*) where i=a for the first buoy and the first chamber and i=b for the second buoy and the second chamber, is greater than the weight of the assembly of said first mooring buoy and said anchor lines for said first watertight chamber or respectively greater than the weight of the assembly of said second mooring buoy and said link pipes for said second watertight chamber.

13. The method according to claim 12, wherein a further step is performed comprising completely emptying said first or second chamber respectively and then making said emptied first or second chamber watertight, and after said first or second chamber has been emptied, the bottom ends of said hoist cables are detached from said first or second mooring buoy, respectively, and retaining means for mechanically retaining said first or said second mooring buoy, respectively, are engaged, thereby securing it to the bottom wall of said turret.

14. The method according to claim 13, wherein a said first or second buoy connected to a said turret is disconnected, wherein after the bottom ends of said hoist cables have been separated from said first or second mooring buoy, the method comprises the following steps:

a) causing water to enter at least into said first or second watertight chamber respectively in such a manner that the level of water in said guide tubes co-operating with said first or second chamber respectively comes just above said level H1*i* with i=a for the first chamber and i=b for the second chamber; and b) for disconnecting said second buoy, unlocking said connectors between said first and second connection pipes; and c) releasing said mechanical retaining means to separate said first or second mooring buoy respectively from said bottom wall of the turret; and d) ending by filling the guide tubes in communication with the chamber, thereby causing said buoy to be disconnected.

15. The method according to claim 14, wherein for disconnecting from said second mooring buoy, the following steps are performed:

a) depressurizing said first and second bottom-to-surface connection pipes; and b) filling said second chamber or valve chamber up to said height H2*b* from the underface of the bottom wall of the turret, and stopping filling as soon as said valve chamber is completely filled with water; and c) releasing said connectors between said first and second connection pipes;

d) where appropriate, releasing said mechanical safety latches; and e) continuing to fill said valve chamber so as to fill the guide tubes up to said height H1*b*.

16. The method according to claim 14, wherein the following steps are performed:

1) disconnecting said second buoy relative to said turret while keeping said first buoy connected to said turret; and 2) lowering said second buoy to a certain depth of immersion below said floating support while keeping the first link pipes moored to the second buoy.

* * * * *